US008920251B2

(12) United States Patent
Dietz et al.

(10) Patent No.: US 8,920,251 B2
(45) Date of Patent: Dec. 30, 2014

(54) AMUSEMENT RIDE

(71) Applicants: Thomas Dietz, Stuttgart (DE); Andreas Pott, Sindelfingen (DE); Gino De-Gol, Warwick (GB); Alexander Verf, Ludwigsburg (DE)

(72) Inventors: Thomas Dietz, Stuttgart (DE); Andreas Pott, Sindelfingen (DE); Gino De-Gol, Warwick (GB); Alexander Verf, Ludwigsburg (DE)

(73) Assignees: Alexander Verl, Ludwigsburg (DE); Gino De-Gol, Warwick (GB)

( * ) Notice: Subject to any disclaimer, the term of this patent is extended or adjusted under 35 U.S.C. 154(b) by 6 days.

(21) Appl. No.: 13/623,208

(22) Filed: Sep. 20, 2012

(65) Prior Publication Data

US 2013/0079169 A1 Mar. 28, 2013

(30) Foreign Application Priority Data

Sep. 23, 2011 (DE) ..... 10 2011 114 371

(51) Int. Cl.

| | |
|---|---|
| ***A63G 31/02*** | (2006.01) |
| ***A63G 21/20*** | (2006.01) |
| *A63F 13/02* | (2006.01) |

(52) U.S. Cl.

CPC ..... *A63G 31/02* (2013.01); *A63G 21/20* (2013.01)

USPC ..... 472/59; 472/130; 434/55

(58) Field of Classification Search

CPC ..... A63G 19/20; A63G 31/00; A63G 31/02; A63G 31/16; A63F 13/02; A63F 13/12; A63B 22/00; A63B 22/16

USPC ..... 472/50, 59, 75–78, 80, 130; 434/29, 55; 104/112–113, 117, 117.1; 105/30, 148, 105/150, 151

See application file for complete search history.

(56) References Cited

U.S. PATENT DOCUMENTS

| | | | | |
|---|---|---|---|---|
| 3,847,085 | A * | 11/1974 | Rypinski | 104/122 |
| 5,585,707 | A | 12/1996 | Thompson et al. | |
| 6,319,140 | B1 * | 11/2001 | Mirfin et al. | 472/131 |
| 6,511,381 | B1 * | 1/2003 | Cochron | 472/46 |
| 6,695,291 | B2 * | 2/2004 | Kleimeyer et al. | 254/266 |
| 7,624,684 | B2 * | 12/2009 | Morris | 104/112 |
| 7,922,594 | B2 | 4/2011 | Verl et al. | |

FOREIGN PATENT DOCUMENTS

| | | | |
|---|---|---|---|
| DE | 10 2008 005 859 | A1 | 7/2009 |
| EP | 1 063 064 | A2 | 12/2000 |
| EP | 2 394 720 | A2 | 12/2011 |
| KR | 200 453 067 | Y1 | 4/2011 |

* cited by examiner

*Primary Examiner* — Kien Nguyen

(74) *Attorney, Agent, or Firm* — Gudrun E. Huckett

(57) ABSTRACT

An amusement ride has a retaining structure and at least one platform that is connected in an articulated manner to retaining elements which hold the at least one platform on the retaining structure. The retaining elements are cables which are under tensile stress during operation of the amusement ride. The cables have an effective length and the effective length of the cables is variable. Cable winches disposed on the retaining structure are provided that wind the cables.

22 Claims, 25 Drawing Sheets

AMUSEMENT RIDE

BACKGROUND OF THE INVENTION

The invention relates to an amusement ride having at least one platform which is connected in an articulated manner to retaining elements which hold the platform.

Amusement rides are known (DE 10 2008 005 859 A1), in which a platform is connected via retaining elements in the form of λ-drives or straight rods to drives which are moved along guides. With the aid of the drives, the platform can be adjusted in different positions and orientations.

It is the object of the invention to configure the generic amusement ride so that the movement of the platform is achieved in a constructively simple manner.

SUMMARY OF THE INVENTION

This object is solved in an amusement ride of the aforementioned kind according to the invention in that the retaining elements are cables, which are under tensile stress during operation of the amusement ride.

In the amusement ride according to the invention, the retaining elements are formed by cables which are under tensile stress during operation of the amusement ride. As a result of this configuration, the platform is held securely in each position and orientation.

A cable is to be understood not only as cables in the narrower sense but in general as flexible elements which can be placed under tensile stress and with which the functions described in the claims and in the description of the figures can be executed.

The effective length of the cables can advantageously be varied. As a result, the platform on which several cables act can be adjusted very simply into the desired positions and/or orientations.

The cables are advantageously wound onto cable winches for variation of the effective cable length.

In an advantageous embodiment the cables are connected to drives which are movable along guides. With the aid of these drives which form carriages, the platform can be moved along the guides to the desired extent. These guides can extend in most diverse directions depending on the configuration of the amusement ride. Through coordinated movement of the cable ends, a movement of the platform in the desired direction and orientation can be achieved.

If a complete control of all six degrees of freedom (three translational and three rotational degrees of freedom) of the platform is to be achieved, at least seven cables are required then. In an advantageous arrangement an increase in the number of cables leads to an increase in the possible movement space. With a reduced movement dynamics of the platform in which less than six degrees of freedom are provided, the number of cables can be reduced to the number of degrees of freedom. In such a case, the platform's own weight is used to stabilize its movement.

It is particularly advantageous if these drives are provided with cable winches onto which the cables can be wound. It is thereby possible to vary the effective length of the cables during travel of the drives. As a result, the platform can be adjusted into the desired positions and/or orientations during travel.

A dedicated motor is advantageously used for driving the cable winches so that the length variation of the cables can be varied by winding on or unwinding independently of the movement of the drives.

Instead of the cable winches, the effective cable length can also be varied by connecting the ends of the cables facing away from the platform to pivotable levers. The levers are advantageously one-armed levers to the free ends of which the cable ends are fastened. The turning of these levers brings about a comparable effect to the winding of the cables. With such a configuration the platform can also be moved in a defined manner in up to six degrees of freedom.

An optimal adjustment of the platform is obtained if the cable winches or the levers are drivable independently of one another.

The amusement ride can also be configured to that it has no drives which are movable along rails. The platform is then adjusted by adjusting the effective cable lengths in a coordinated manner.

If at least some of the cables are provided redundantly, the supporting function of the remaining cable(s) is ensured in the event of failure of one cable. In addition, the load-bearing capacity is increased due to the redundantly provided cables.

In a preferred embodiment at least one elastically resilient element is located in at least in some of the cables or in the connection of the cables to the platform or in the connection of the cables at the end remote from the platform. Such elements can, for example, absorb energy when the amusement ride is at a standstill, for example, and limit or intercept forces which occur as a result in the event of a loss, for example, when synchronising the cable winches or when suddenly tensioning individual cables.

In this case, it is possible that the elastically resilient element is effective permanently. However it is also possible that the elastically resilient element only becomes effective when for example the cable tension is released. The cable tension is monitored by corresponding sensors and the like and the elastically resilient element is then released when the cable tension falls below a predefined value or a non-controlled braking process (stop 0) is initiated. The elastically resilient element is primarily of interest to be passively activated when there is a loss of supply voltage, e.g. in the event of a power failure or in the event of a control error. In this rest current principle, the elastically resilient element is automatically activated as soon as the supply voltage decreases.

In an advantageous embodiment, at least one energy dissipation element is provided in at least some of the cables. It forms an irreversibly plastically deformable element, preferably in the form of a crumple element that absorbs excessive forces which occur when the amusement ride is at a standstill, for example, as a result of a defect, due to plastic deformation. This prevents any overloading of the structure of the amusement ride and/or the passengers located on the platform.

The energy dissipation element, like the elastically resilient element can be disposed in the cables but also at the connecting points to the platform or to the drive.

The energy dissipation element can be effective permanently or in the case of braking of the cables or the platform.

In an advantageous embodiment, in the region of the platform or in the region of the cable winches, cable tensioning elements act on at least some of the cables, which pretension and deflect the corresponding cable. A defined resilience and compensation for the cable tensions is thereby ensured. In particular, such a design is advantageous with two or more parallel guided cables.

In a simple embodiment, the cable winches are disposed in the region above the platform where the cables are held tensioned under the weight of the platform.

The drives and/or the motors of the cable winches or the lever are advantageously connected to a common controller.

An optimal adjustment of the platform with regard to position and orientation is obtained when the drives and/or the motors of the cable winches or the levers lie in a control circuit of the controller. Then the platform can be reliably adjusted into the desired positions and orientations.

Advantageously the motor of the cable winch or the lever lies in a drive train which is provided with at least one brake for a cable drum of the cable winch or for the lever.

If the brake is provided redundantly, stoppage of the amusement ride is ensured in the event of failure of an individual brake. The redundantly provided brakes furthermore increase the braking effect.

It is advantageous if one brake is provided on the motor side and the other brake is provided on the cable drum side.

In order to obtain a force limitation in the cables in a simple manner, in an advantageous embodiment of the cable drum, a friction drive, for example, with slipping clutch is provided before this.

Further details of the invention are obtained from the further claims, the description and the drawings.

BRIEF DESCRIPTION OF THE DRAWINGS

The invention is explained in detail by means of some embodiments shown in the drawings. In the figures

DESCRIPTION OF THE PREFERRED EMBODIMENTS

Figure 1:
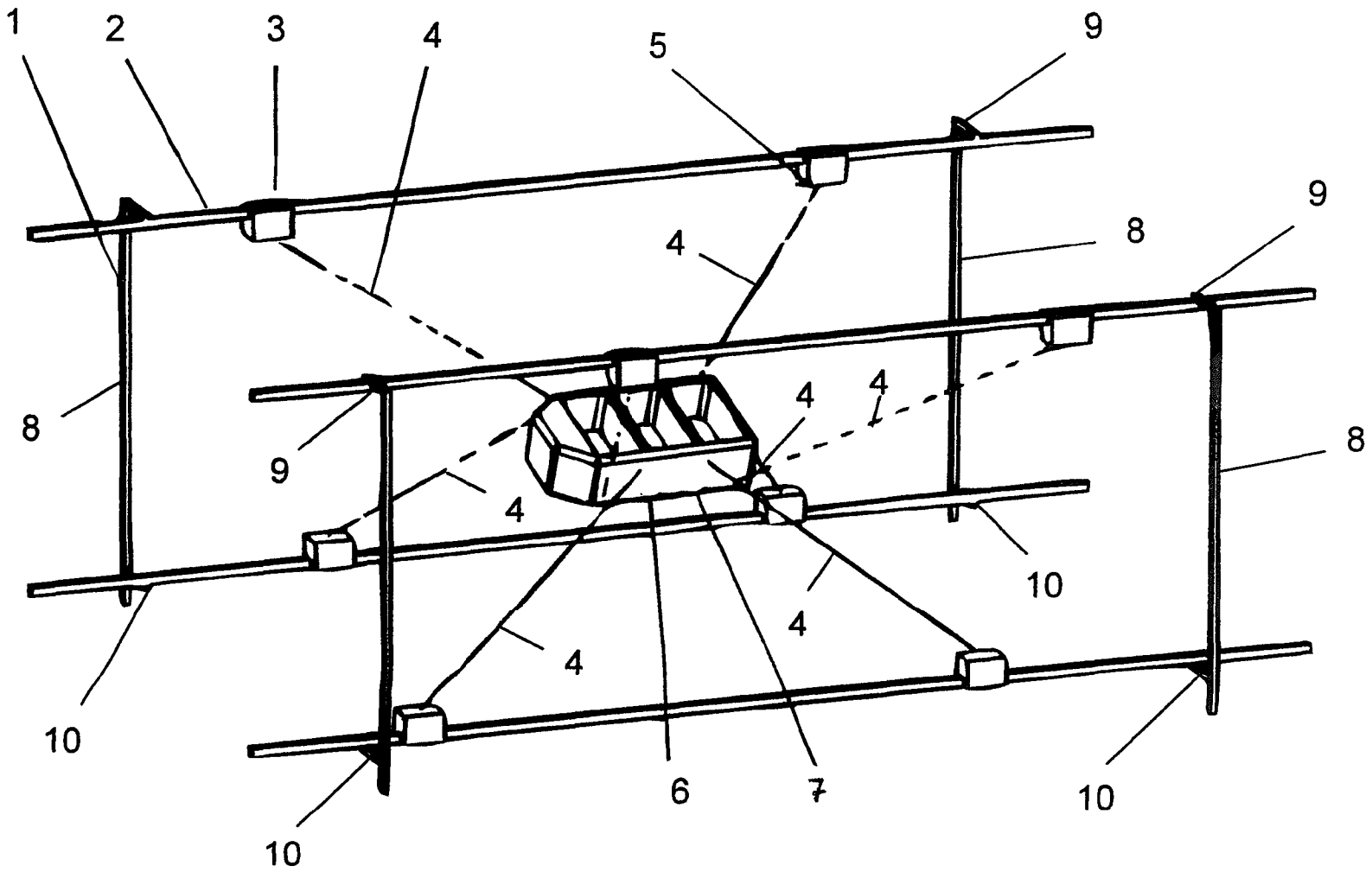
FIG. 1 shows in schematic and perspective view a first embodiment of an amusement ride according to the invention, FIG. 2 to FIG. 4 each shown in plan view different movements of a platform of the amusement ride according to the invention according to FIG. 1.

The amusement ride according to FIGS. 1 to 4 has a retaining structure 1 on which rails 2 running parallel to one another are fastened. Carriages 3 on which are mounted winches 5 onto which cables 4 are wound as retaining element are movable on these rails. The cables 4 are fastened with their ends 6 on a platform 7.

In the exemplary embodiment the retaining structure 1 consists of vertical supports 8 each bearing two rails 2 running parallel to one another and horizontally. The supports 8 are arranged in a distributed manner over the length of the rails 2. The rails 2 lie opposite one another and advantageously at the same height. The superposed rails 2 advantageously lie in a common vertical plane.

At the upper end and close to the lower end transverse members 9, 10 protrude from the supports 8, the rails 2 being fastened at the free ends thereof.

Depending on the configuration of the amusement ride, the rails can be of different length. The platform 7 can thus be moved over longer distances, for example, several hundred meters, along the rails. Such amusement rides are, for example, roller coasters in which the platform 7 is moved over such long distances. The rails 2 are shown as running horizontally, only as an example in the drawings. Depending on the configuration of the amusement ride, the rails 2 can have a different course, for example, curved upwards or downwards or to the side or intertwined in the manner of a roller coaster, for example.

The rails 2 can also form a closed path, e.g., a ring. It is thereby possible to move a plurality of platforms 7 one behind the other through the same course.

The carriages 3 which have winches 5 for winding the cables 4 are moved along the rails 2. With the aid of the carriages 3 the winches 5 are moved along the rails 2 according to their course.

The carriages 3 are driven by separate motors.

The cables 4 are configured so that they can reliably support the platform 7. The cables 4 can, for example, be made of steel or of synthetic or natural fibres. The cable ends 6 are fastened to the platform 7 at defined points The other cable ends are wound onto the winches 5 which are provided on the carriages 3. The winches 5 are driven with a safety-related drive system so that it is possible to transport persons. With the winches 5 the free cable length can be measured by, for example, detecting the degree of rotation of the winches 5. Accordingly, the winches 5 can be specifically turned so that a defined free cable length is adjusted. If this is necessary, the winches 5 can be provided with sensors to assist the control and regulation of the movement and orientation of the platform 7.

The carriages 3 are moved on the rails 2 so that the cables 4 are always under tension. As a result, the platform 7 is securely held in any position and orientation. The fastening of the cable ends 6 on the platform 7 is selected with a view to the positional stabilisation of the platform 7.

The platform 7 which, in the exemplary embodiment according to FIGS. 1 to 4 is held by eight cables 4, can be configured as an open platform or as a closed cabin. Passengers transported by the amusement ride are located on the platform. The platform 7 can have seats for the passengers.

The own weight of the platform 7, the additional weight of the passengers and dynamic loads during travel of the platform 7 are distributed over the individual cables 4.

The carriages 3 are driven independently of one another. The winches 5 on the carriages 3 are also driven rotatably independently of one another. It is thereby possible to bring the platform 7 into the most diverse positions and orientations during travel along the rails 2. This adjustment of the platform 7 is also possible when no movement takes place along the rails 2. In such a case the amusement ride can be without rails. The movement of the platform 7 is then accomplished by varying the effective cable length of the various cables 4.

Figure 2:
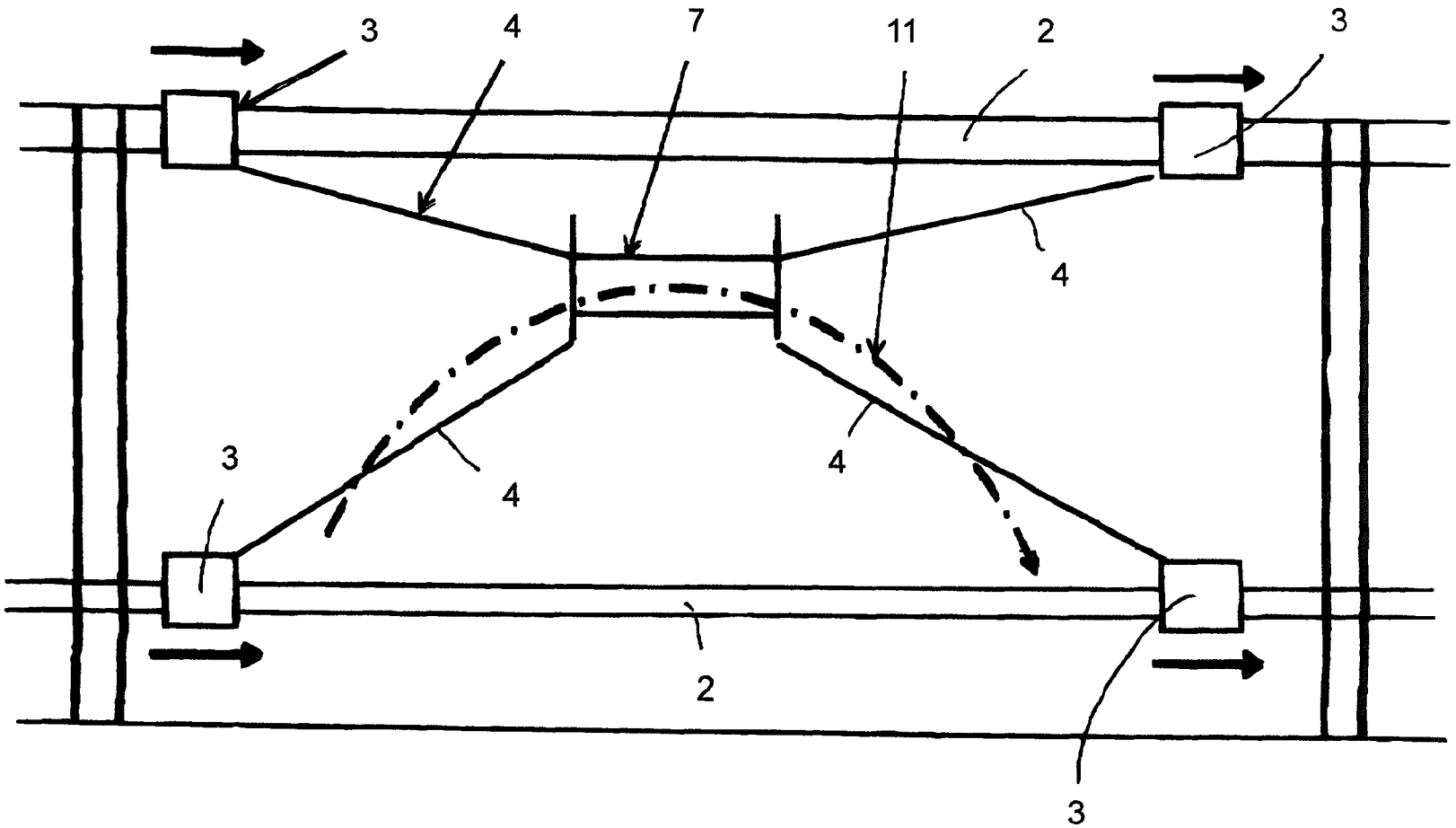
Figure 3:
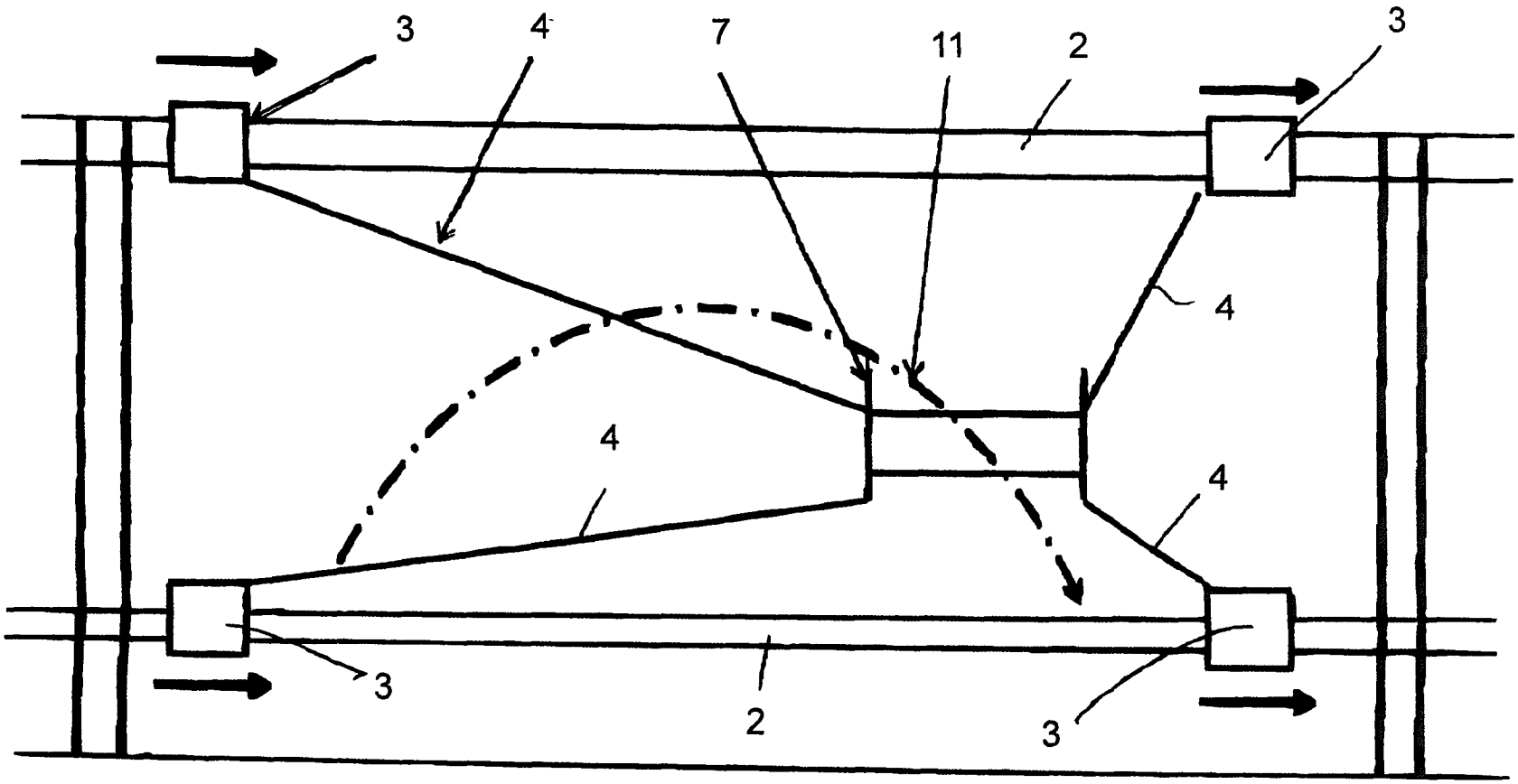

As an example, FIGS. 2 and 3 show how the platform 7 can move along the path identified by a dot-dash line 11. In this case, the carriages 3 move at the same speed along the rails 2 where, however, the winches 5 are turned differently. As a result, the free cable lengths vary, with the result that the platform 7 executes the movement path 11. The rotational speed of the winches 5 is varied during travel of the carriages 3 according to the desired movement path 11 of the platform 7. The arrow indicates the movement path 11 in which direction the platform 7 moves relative to the carriages 3 during their travel. In the position according to FIG. 2, the platform 7 is located closest to the upper rails 2. The free cable lengths of the lower cables 4 are accordingly longer than the free cable lengths of the upper cables 4. Accordingly, the winches 5 of the two upper carriages 3 in FIG. 2 have been turned so that they wind on the corresponding cable length whereas the winches 5 of the lower carriages 3 in FIG. 2 have been rotatably driven so that they unwind the cable length.

In the position according to FIG. 3 the platform 7 is located ahead of the front end of the movement path 11 in the direction of motion. The two left cables 4 in FIG. 3 have been unwound very far from the corresponding winches whereas the two right-hand cables 4 in FIG. 3 have been wound onto the winches for the most part.

Since the movement path 11 runs in a parabolic shape, the winches of the carriages 3 are accordingly turned continuously in the required direction. The carriages 3 themselves travel at the same speed along the rails 2.

Figure 4:
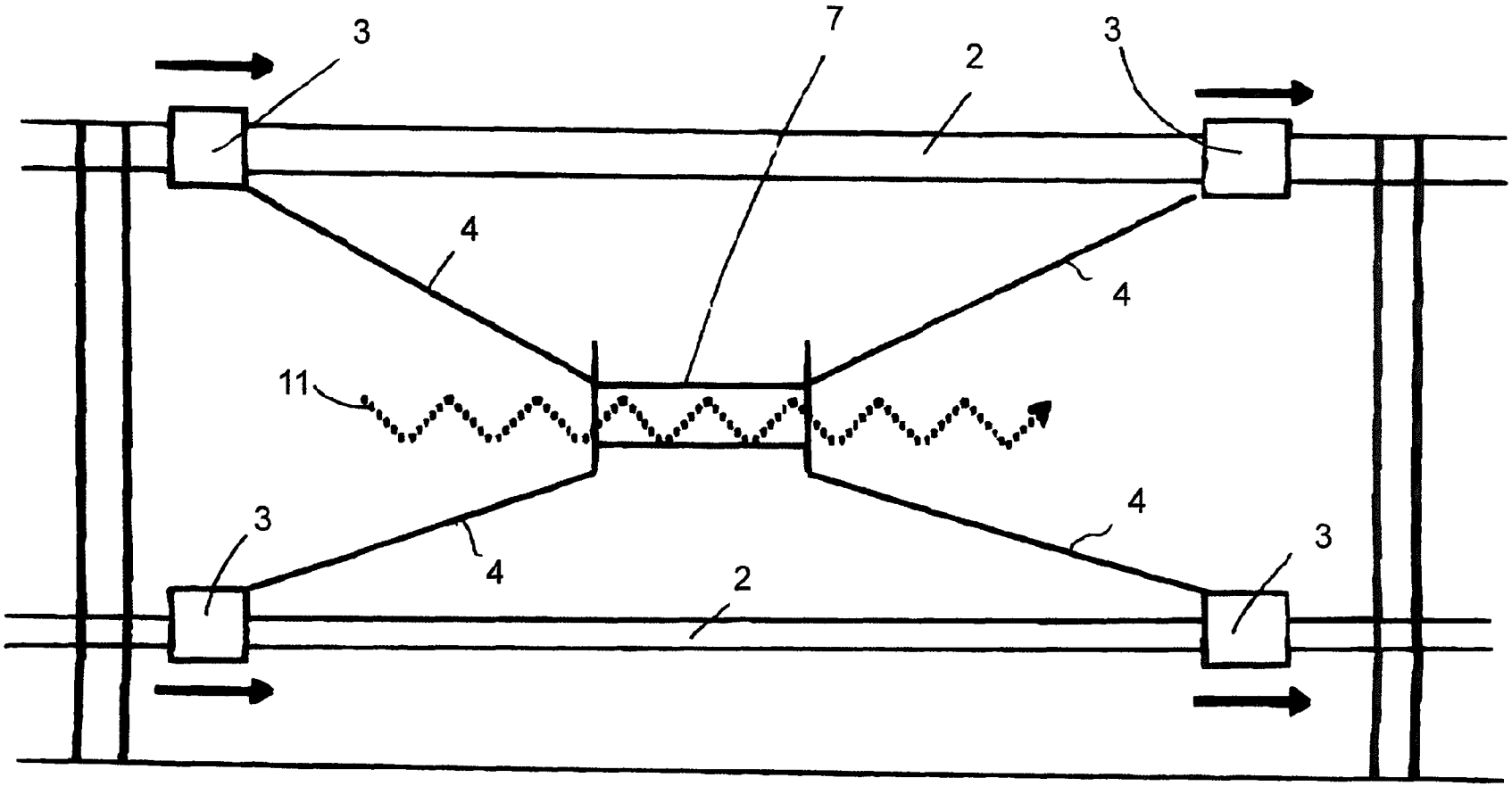

FIG. 4 shows as an example another possibility as to how the platform 7 can be moved along the rails 2 during travel of the carriages 3. A zigzag-shaped movement path 11 is shown as an example. This is achieved by continuously turning the corresponding winches of the carriages 3 moving at the same speed alternately in one or the other direction so that the corresponding cables 4 are alternately wound and unwound. The impression of trembling or vibrations is given to the passenger on the platform 7.

The movement paths 11 indicated in FIGS. 2 to 4 are to be understood only as examples. The platform 7 can execute most diverse movement paths according to how the winches 5 are turned and the carriages 3 are moved. As a result of a corresponding programming of the individual winches 5, arbitrary movement profiles of the platform 7 can be produced within certain limits.

The use of winches 5 on the carriages 3 enables the platform 7 to be made to execute the most diverse movements. During the entire movement of the platform 7 the cables 4 are always under tensile stress so that the platform 7 is safely held at all times.

Figure 22:
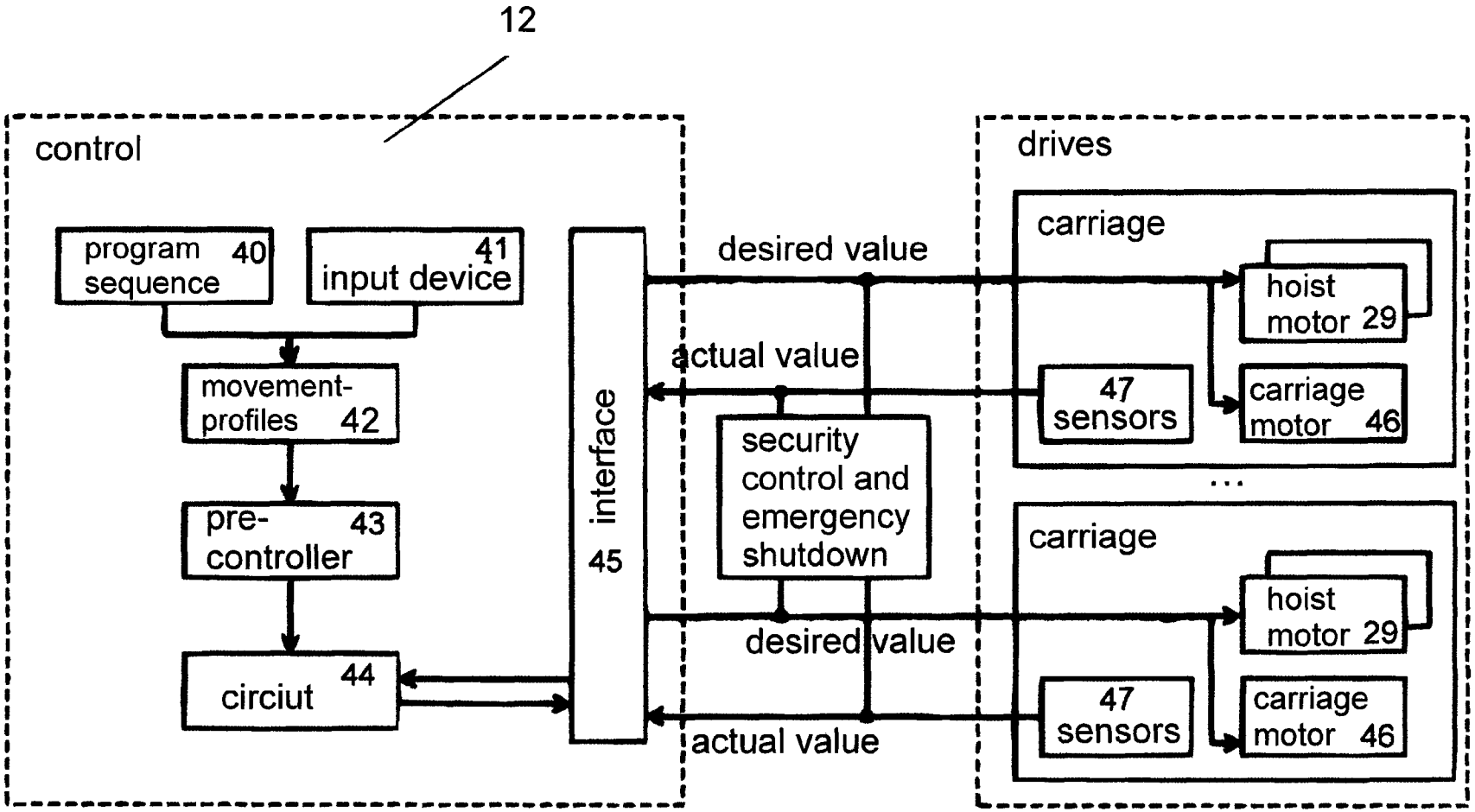
FIG. 22 shows in schematic view a control system to which the drives of the amusement ride according to the invention are coupled

A high mobility and dynamics of the movements of the platform 7 can be achieved with the cables 4. In the embodiments described the effective free length of the cables 4 is achieved by winding and unwinding the cables 4 onto or off the winches 5. The effective free cable length that is set with the aid of the winches 5 and the movement of the carriages 3 along the rails 2 is predefined by a central controller 12 (FIG. 22). With this controller the platform 7 can be brought into a defined position and orientation. The platform 7 can be controlled by the controller 12 such that it travels along a defined path 11 by a corresponding movement program. The values set for a specific amusement ride depend on the type of amusement ride and on the desired movement speeds and accelerations. Since the winches 5 are arranged distributed around the platform 7, the platform 7 is clamped and moved within the available movement range by coordinated length variation of the cables 4. The platform 7 therefore moves relative to the winches 5 or the carriages 3. In addition to this movement, a superposition with the movement executed by all the carriages 3 is produced. In order to achieve a complete control over all six degrees of freedom of the platform 7 (three translational and three rotational degrees of freedom), at least seven winches 5 are required. In the exemplary embodiment shown, eight winches and accordingly eight cables 4 are provided which frequently proves to be advantageous.

Depending on the type of amusement ride, it is possible that the platform 7 has less than six degrees of freedom. With a reduced movement dynamics, the number of winches 5 can then be reduced to the number of degrees of freedom. In this case, the weight of the platform 7 is used to stabilise its movement.

Figure 5:
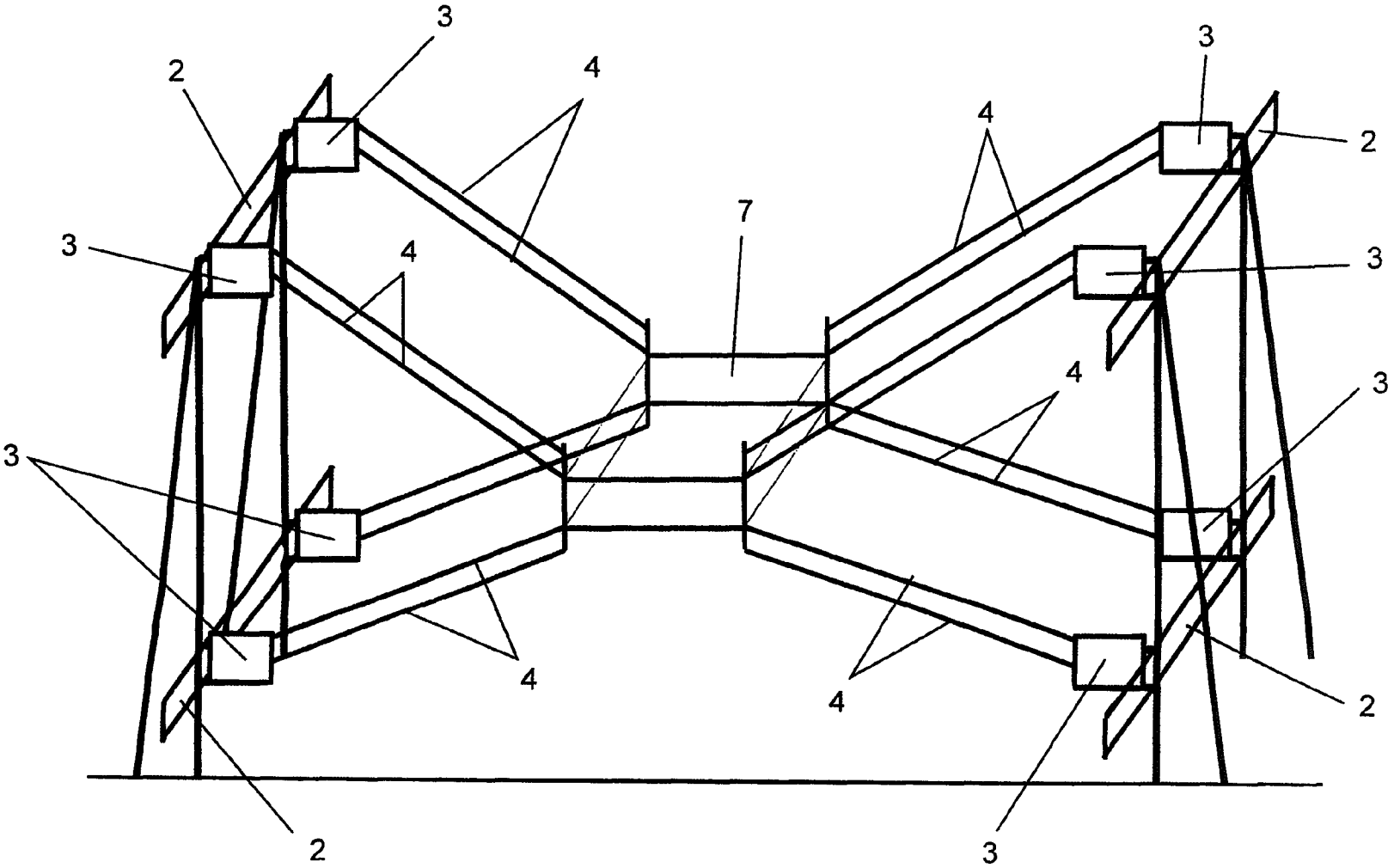
FIG. 5 shows in perspective and schematic view a second embodiment of an amusement ride according to the invention.
Figure 6:
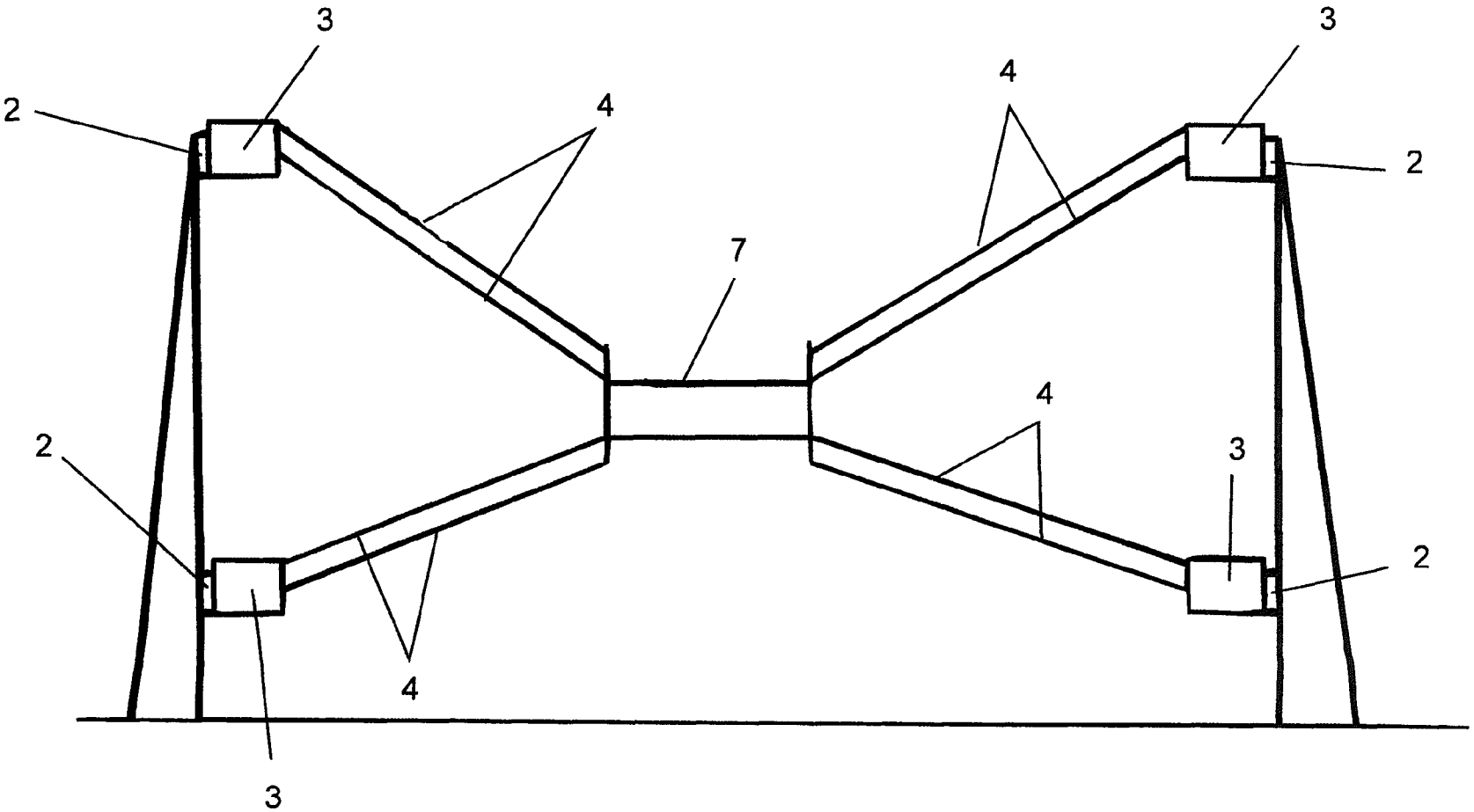
FIG. 6 shows a front view of the amusement ride according to FIG. 5.

FIGS. 5 and 6 show an embodiment of an amusement ride with parallel cables 4 on each of the carriages 3. A redundancy is thereby achieved which ensures the supporting function of the remaining cable(s) in the event of the failure of one cable. In the exemplary embodiment shown the cables 4 are arranged as parallelograms where each carriage 3 has two cables 4 and accordingly also two winches 5. Otherwise, this amusement ride operates in the same way as the exemplary embodiment according to FIGS. 1 to 4.

A redundancy of the cables can also be provided so that three cables can be provided as a double parallelogram in linear arrangement or in triangular arrangement as well as four cables in a row, as parallelograms or in a columnar arrangement.

Figure 6A:
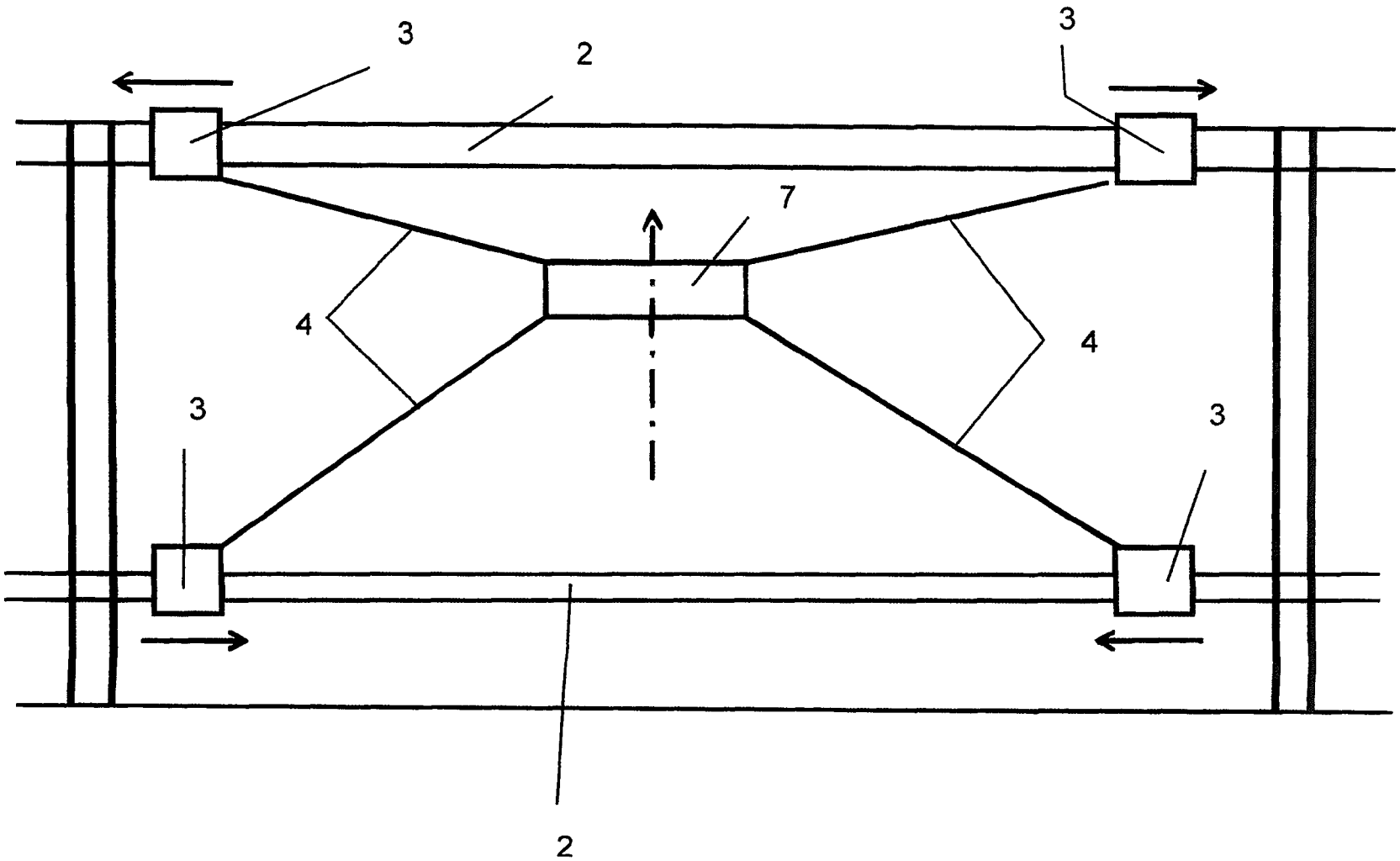
FIG. 6*a* shows an embodiment of an amusement ride according to the invention in which the platform is connected to carriages by means of invariable-length retaining elements.

In the exemplary embodiments it possible that the carriages 3 can be moved on the rails 2 controlled at different speeds so that the platform 7 executes the desired movement path 11. In such a case, invariable-length retaining elements 4 can also be used which in this case need not consist of cables but can also be rods, for example, made of steel or fibre composite materials such as carbon or glass fibre. FIG. 6*a* shows such an embodiment. In such a case a drive and rolling up system for the winches can be dispensed with. In such a case, the retaining elements 4, preferably the cables, are directly connected to the carriages 3. The movement of the platform 7 is then exclusively determined by the movement of the carriages 3 relative to one another which are moved by motor along the rails 2. With such a configuration it is also possible to control the orientation and position of the platform 7 by a relative movement of the carriages 3 with respect to one another. In such a configuration the carriages 3 and therefore the platform 7 can also be moved over longer distances. By superposition of these two movements (movement of the carriages 3 along the rails 2 and relative adjustment of the carriages 3 to one another), the platform 7 can be moved along the rails 2 and at the same time its positioning and orientation can be varied. The direction arrows in FIG. 6*a* indicate as an example how the platform 7 can be moved in the direction of the dot-dash arrow by appropriate movement of the carriages 3 on the rails 2.

The use of additional redundant cables 4 (FIGS. 5 and 6) allows a high failure safety, an increase in the useful load and also an increase in the movement space of the platform 7.

Figure 7:
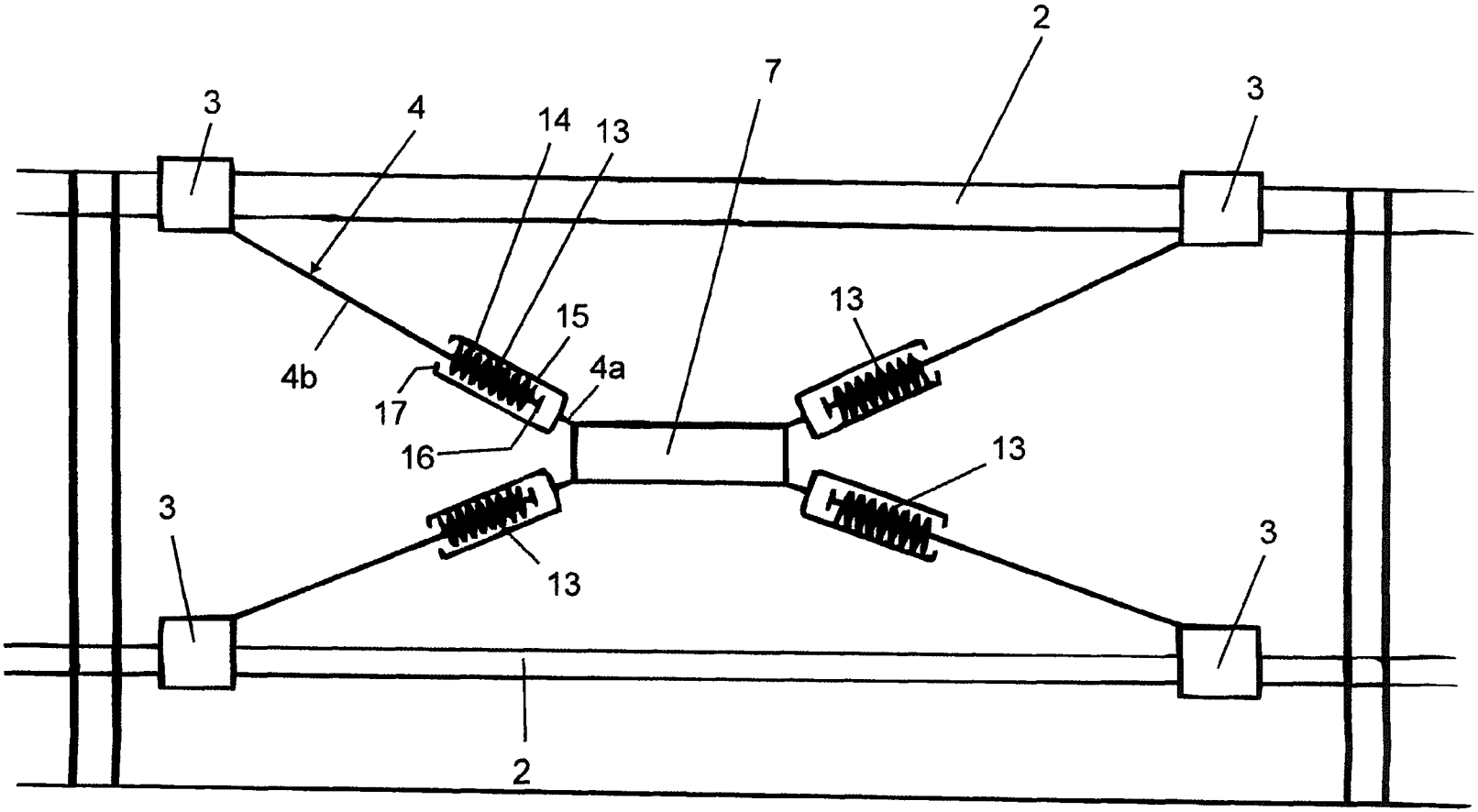
FIG. 7 shows in schematic view and in plan view a third embodiment of an amusement ride according to the invention.
Figures 8, 9, 10, 11:
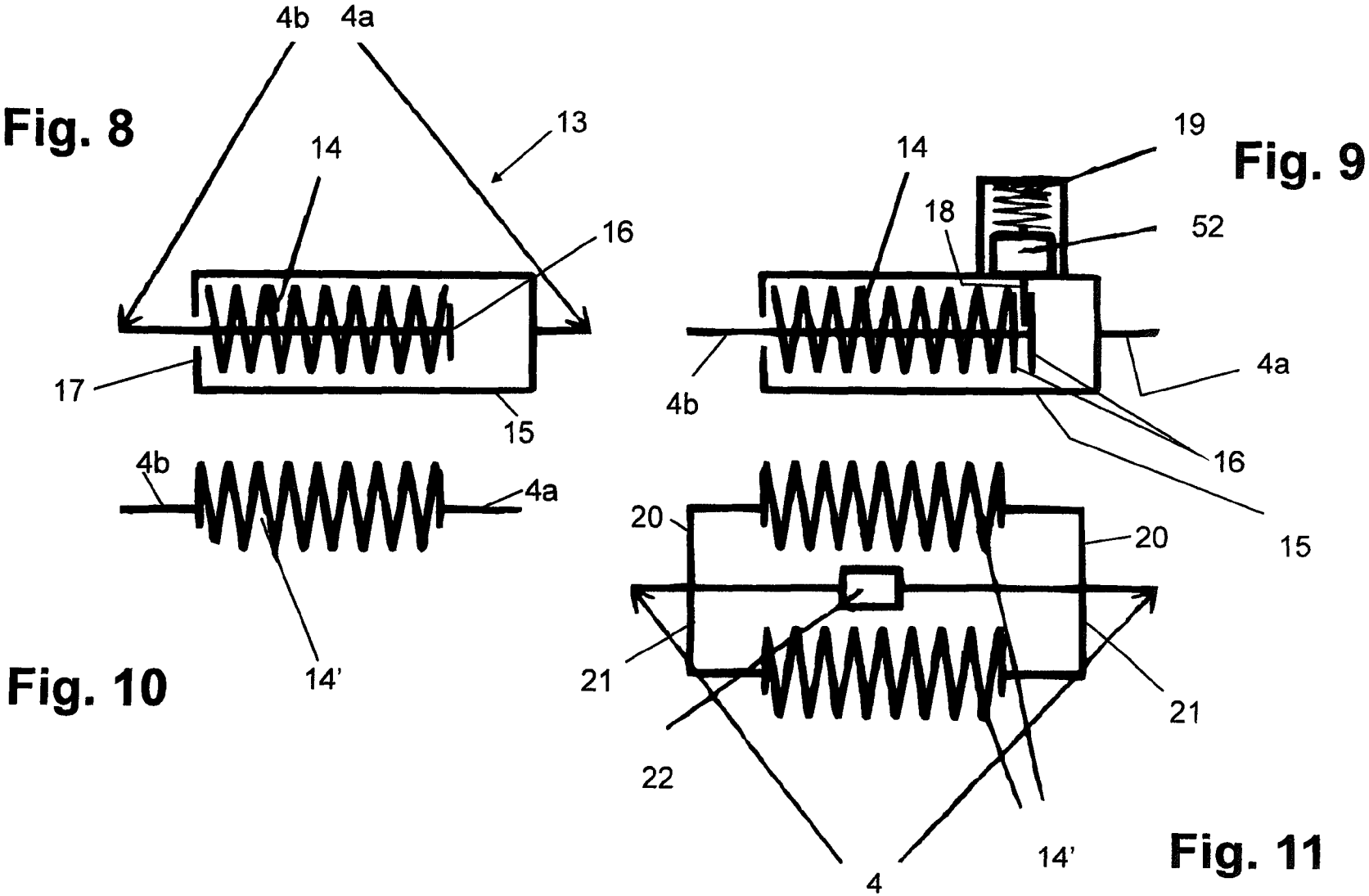
FIG. 8 to FIG. 11 show various embodiments of elastically resilient elements in the drive train of the amusement ride according to the invention.

FIGS. 7 and 8 show as an example an embodiment in which elastically resilient elements 13 are disposed in the cables 4 in the region between the carriages 3 and the platform 7. These elements 13 make it possible to produce soft movement profiles of the platform 7. Slack cables 4 can be detected with these elements 13 and the correct operation of the amusement ride can be monitored. In the event of a loss of the capability to control the winches 5 and the carriages 3 in a coordinated manner, the elastically resilient elements 13 allow a controlled variation of the effective length under load and thereby limit the excessively high cable forces which possibly occur in this case. In the exemplary embodiment according to FIG. 7, the elements 13 each have at least one compression spring 14 which is accommodated protected in a housing 15. The housing 15 is connected by a cable section 4*a* to the platform 7. The other cable section 4*b* that is surrounded inside the housing 15 by the compression spring 14 projects into the housing 15. The free end of the cable section 4*b* lying inside the housing 15 is provided with a stop 16 on which the other end of the compression spring 14 is supported. The other compression spring is supported on a housing wall 17 through which the cable section 4*b* projects into the housing 15. The compression spring 14 is pre-tensioned in every position of the cable 4 or the cable section 4*b*. The pre-tensioned compression spring 14 ensures that the cable 4 always remains tensioned. The spring force is so high that the cables 4 safely hold the platform 7 in every position (position and orientation). In this embodiment, the elements 13 are continuously active.

FIG. 9 shows a variant of the embodiment according to FIG. 8. In this variant the displacement path of the stop 16 inside the housing 15 is blocked by a blocking pin 18. It is fixed with a switching device 52. The fixing of the blocking pin 18 is cancelled by a corresponding signal of the controller, e.g. in the event of a loss of the winch synchronisation or in the event of a voltage drop at the drives. A tension spring 19 pulls the blocking pin 18 back.

The stop 16 is released so that the compression spring 14 can again tension the cable 4 and from now on is active as a resilient element.

FIG. 10 shows a simplified embodiment of a resiliently elastic element. In this a tension spring 14' connects the two cable sections 4*a*, 4*b* to one another. In this embodiment the spring force is such that the cable having the tension spring can reliably support the platform 7. The tension spring 14' is continuously effective.

In the exemplary embodiment according to FIG. 11, at least two tension springs 14' are provided, which are arranged parallel to the cable 4. The tension springs 14' are connected to the cable 4 via respectively one holder 20, 21. In the region between the tension springs 14' the cable 4 is provided with a switching element 22 with which the correct state of the cable 4 can be detected. The holders 20, 21 act on the cable 4 before and after the switching element 22. The switching element 22 bridges the tension springs 14' during operation. As a result of a signal of the controller, the switching element 22 is deactivated and the tension springs 14' become effective, again tensioning the cable 4 via the holders 20, 21 and limiting the forces occurring in the drive train as resilient elements.

Figure 12:
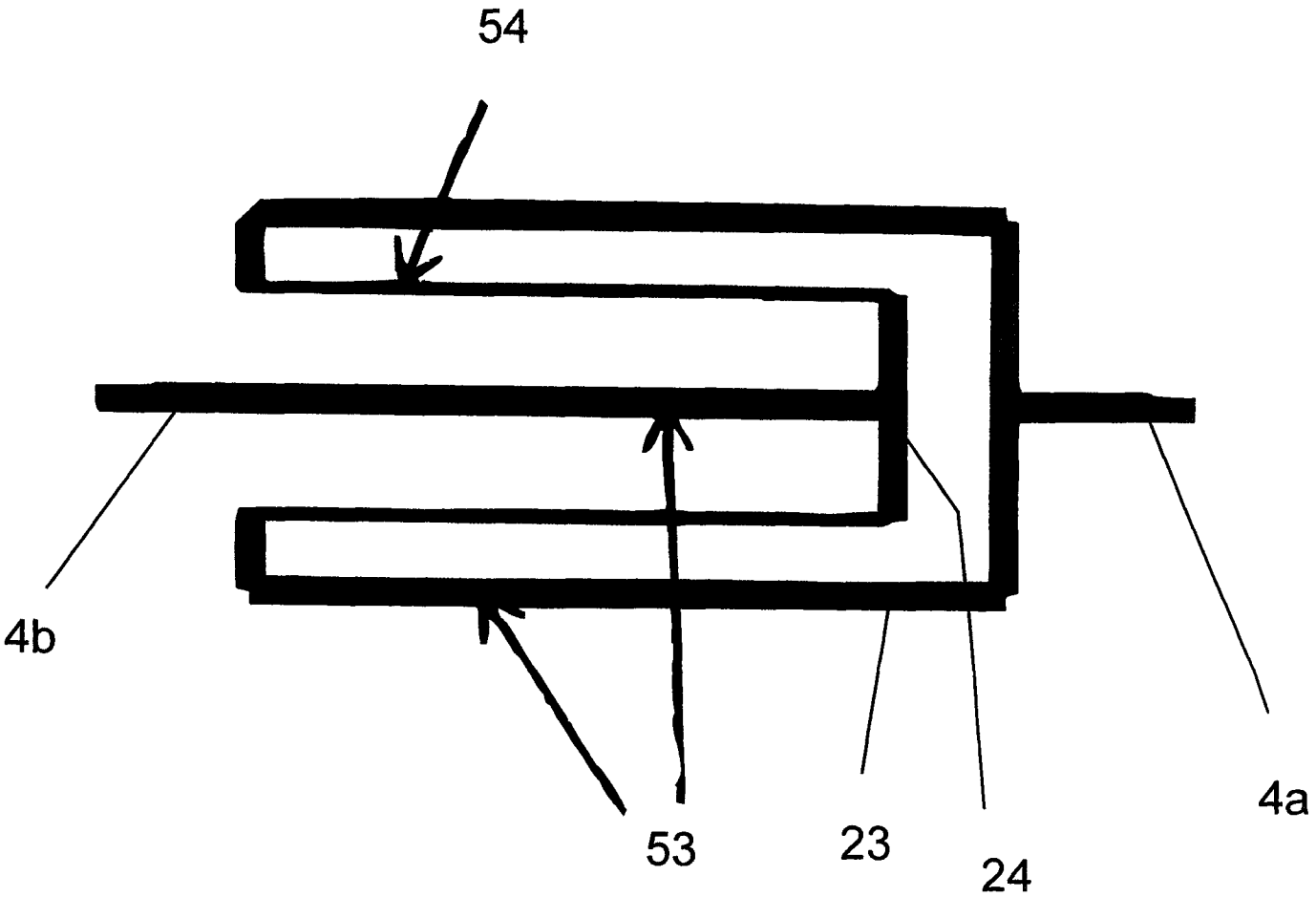
FIG. 12 shows in schematic view an energy dissipation element in the drive train of the amusement ride according to the invention.

FIG. 12 shows a plastically deformable energy dissipation element 53. This has a cylinder 23 to the bottom of which the cable section 4*a* is fastened. The cable section 4*b* is fastened to the bottom 24 of an inner cylinder 54, which is surrounded by the outer cylinder 23 with clearance and is formed in one piece with it. If the cable tension exceeds a predefined value, the inner cylinder 54, which is configured to have thinner walls than the outer cylinder 23, is plastically deformed. Energy is absorbed so that there is no risk for the passengers on the platform 7.

The plastically deformable element can be provided not only in the cable but also in the drive train of the winch 5. Such a design is described further below with reference to FIG. 23.

Figure 13:
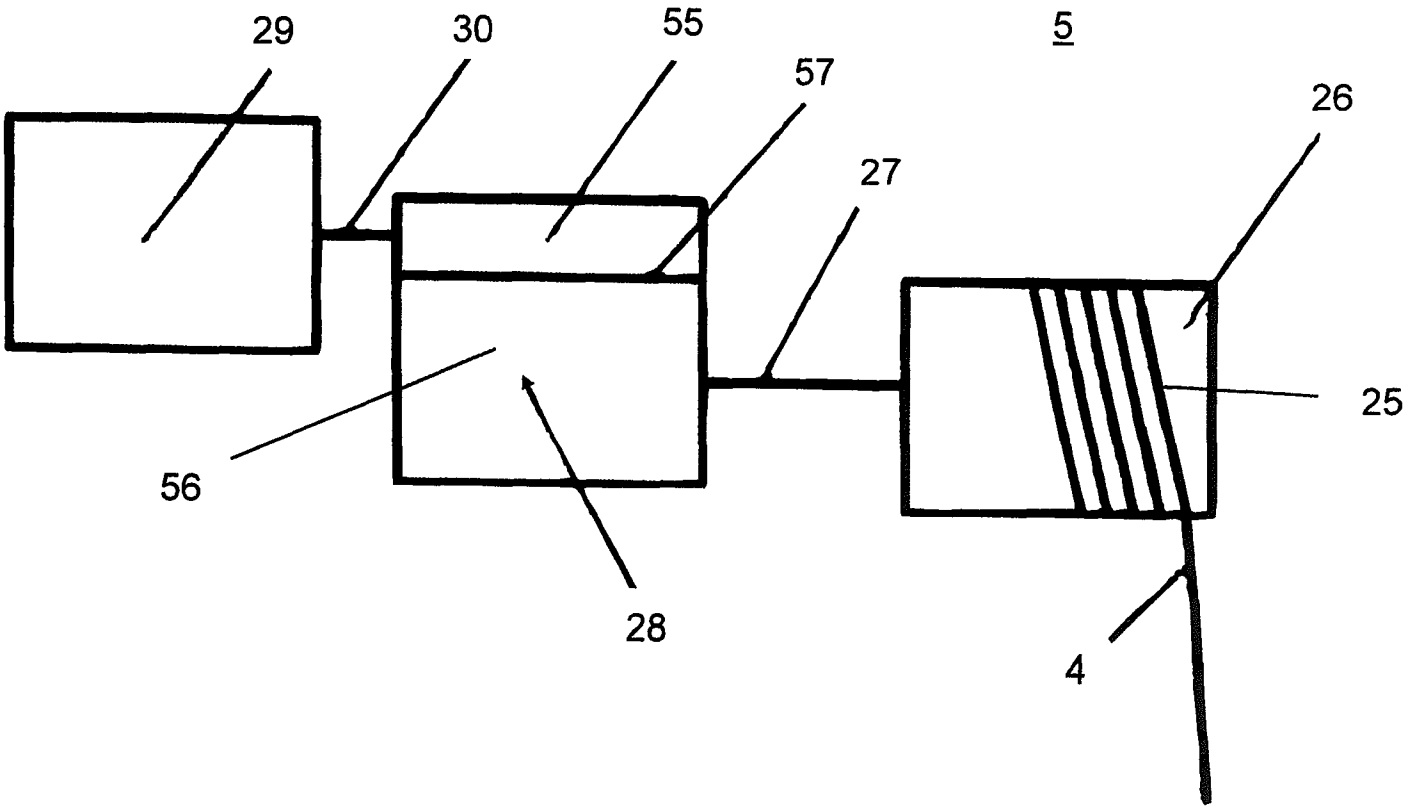
FIG. 13 shows a friction drive of the amusement ride according to the invention in schematic view.

FIG. 13 shows schematically and as an example a friction drive with slipping clutch for the winch 5. This has a drum 26 with a groove 25 running in a coiled manner, which receives the cable 4 to be wound and unwound. The drum 26 is configured so that the cable 4 can be received by the drum 26 without any problems. The drum 26 sits on a driven shaft 27 which is drivingly connected to a motor 29 with an interposed friction unit 28. The motor shaft 30 rotatably drives a friction drum 55, which rests on an axially parallel friction drum 56 (friction contact 57) which sits in a rotationally fixed manner on the driven shaft 27. If the force in the cable 4 exceeds a predefined value, the friction drum 56 slips through, with the result that a torque limitation in the drive train from the motor 29 to the drum 26 is ensured.

The embodiments described with reference to FIGS. 8 to 13 can be used in combination with one another inside the amusement ride so that an optimal adaptation to the particular configuration of the amusement ride is possible.

Figure 14:
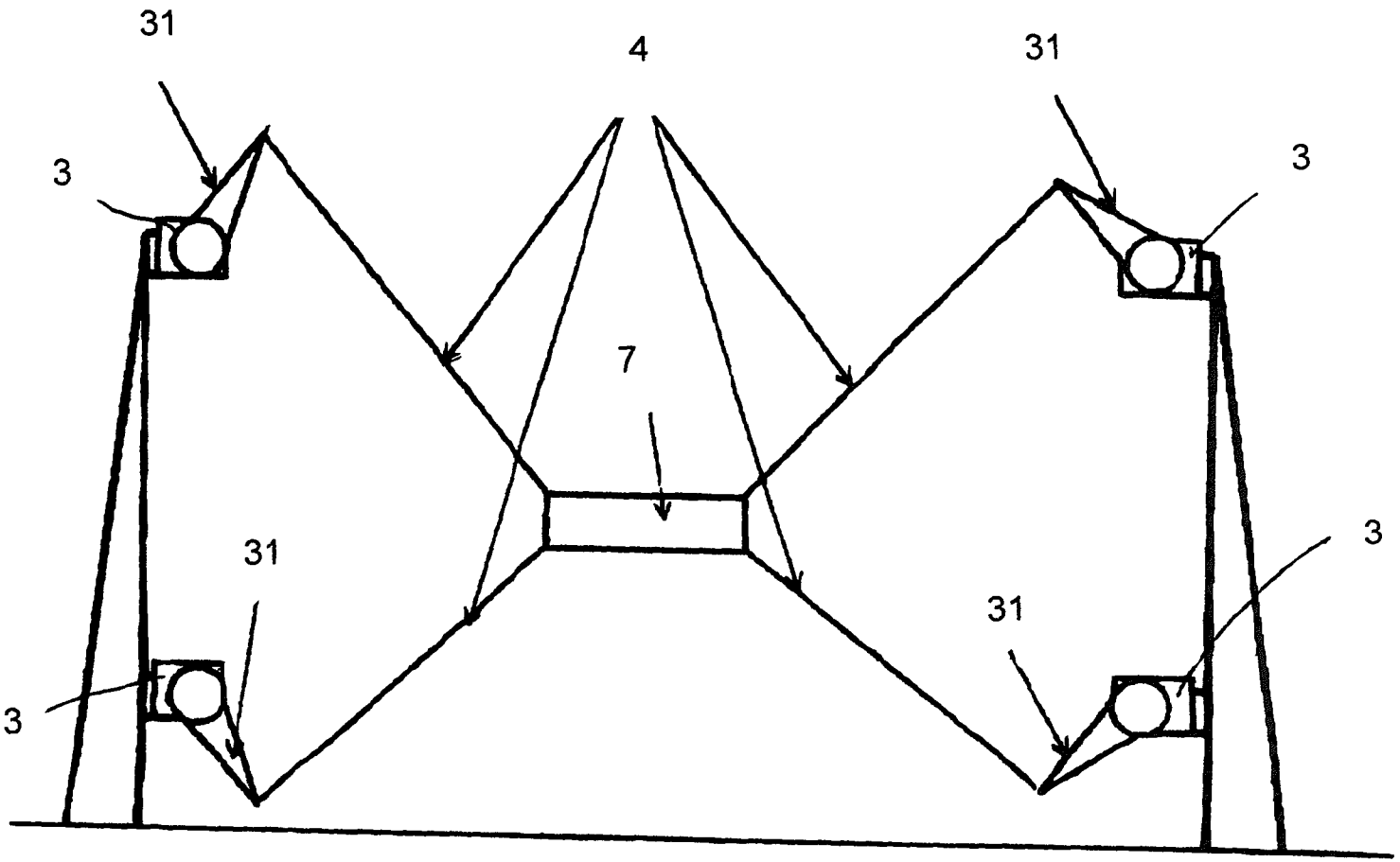
FIG. 14 shows in schematic view a further embodiment of an amusement ride according to the invention.

FIG. 14 shows an amusement ride in which rotating levers 31 are provided instead of winches 5. These are provided on the chassis 3 and are configured as one-armed levers which are turned by a motor in the desired direction. The cables 4 are fastened with their free ends on the levers 31, preferably on the free ends thereof. The pivoting of the levers 31 produces an effect comparable to the winding of the cables 4 onto the winches 5. The levers 31 of the carriages 3 are drivable independently of one another. The platform 7 can thereby be moved in a defined manner in up to six degrees of freedom. Otherwise, the amusement ride according to FIG. 14 is configured to be the same as the previously described embodiments of amusement rides.

Figure 15:
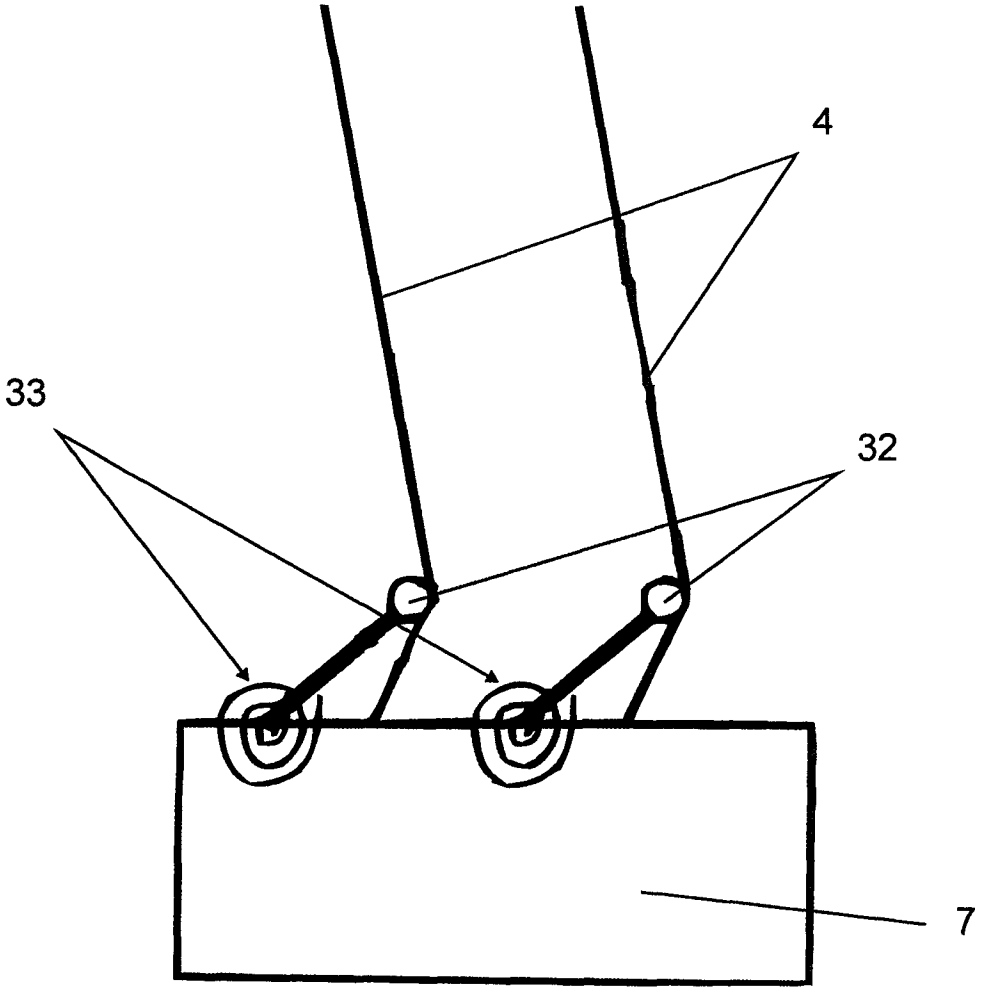
FIG. 15 shows spring elements for deflection of cables of the amusement ride according to the invention.

FIG. 15 shows the platform 7 on which the cables 4 are fastened in the manner described. In this embodiment, the cables 4 are provided in pairs as has been described for example, with reference to FIGS. 5 and 6. In order to achieve a defined resilience and a compensation for the cable tensions in the two parallel guided cables 4, spring-loaded clamping levers 32 are provided in the platform 7 for each cable 4. They are configured as one-armed levers and pivotably mounted with one end on the platform 7. The cables 4 are guided over the free ends of the clamping levers 32 and are deflected in this case. The free clamping lever ends are advantageously configured to be roll- or cylinder-shaped in order to ensure a problem-free deflection of the cables 4. The clamping levers 32 are each under the force of at least one spiral spring 33 which tensions the respective clamping lever sufficiently strongly against the cable so that a cable deflection is ensured.

In the previously described amusement ride the carriages 3 are provided with the winches 5 or the levers 31 in the region above and below the platforms 7. It is also possible to provide the winches 5 or the levers 31 only in the region above the platform 7. In this case, the own weight of the platform 7 is used so that all the cables 4 remain in the tensioned state.

In the embodiments of amusement rides described, the winches 5 or the levers 31 are connected to the carriages 3 so that they are moved together with them. Embodiments are also possible in which one or more winches 5 or levers 31 are connected to the retaining structure 1 in a movably fixed or rigid manner on the rails 2.

In a simpler embodiment of the amusement ride, it is also possible to arrange all the winches 5 or levers 31 in a positionally fixed manner. Then the platform 7 can be adjusted into different positions and orientations in the movement space spanned by the winches or levers. In such a case carriages 3 are not provided.

The amusement ride can be further configured so that the platform 7 only has two translational degrees of freedom with or without a rotational degree of freedom. In such a case the platform 7 moves in the horizontal or in the vertical plane. For such a configuration preferably two, three or four winches 5 or levers 31 are used.

Figure 16:
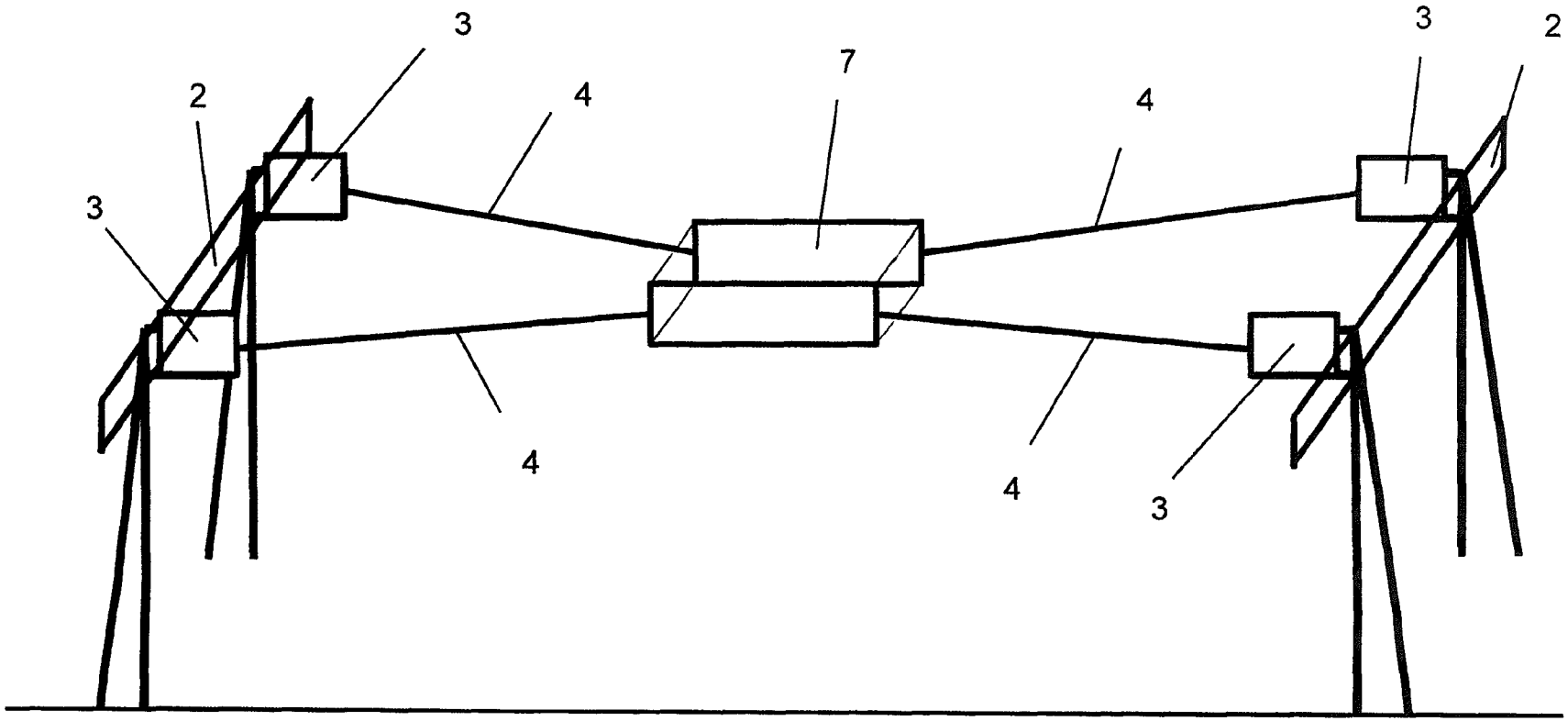
FIG. 16 shows an amusement ride according to the invention in which the platform is only movable in one horizontal plane.

FIG. 16 shows in a schematic view an embodiment in which the platform 7 only moves in a horizontal plane. In this embodiment the amusement ride has two mutually opposite rails 2 which lie at the same height and along which respectively two carriages 3 can be moved. The carriages 3 are connected to the platform 7 via respectively one cable 4. Each carriage 3 is provided with a cable winch onto which the cable 4 can be wound. The spacing of this cable winches on each rail 2 is greater than the length of the platform 7. The winches are controlled so that the platform 7 is moved exclusively in a horizontal plane.

Instead of the carriages 3, cable winches provided in a positionally fixed manner can be provided in the two rails 2. The platform 7 can also be moved in the horizontal plane by coordinated triggering of the cable winches.

Figure 17:
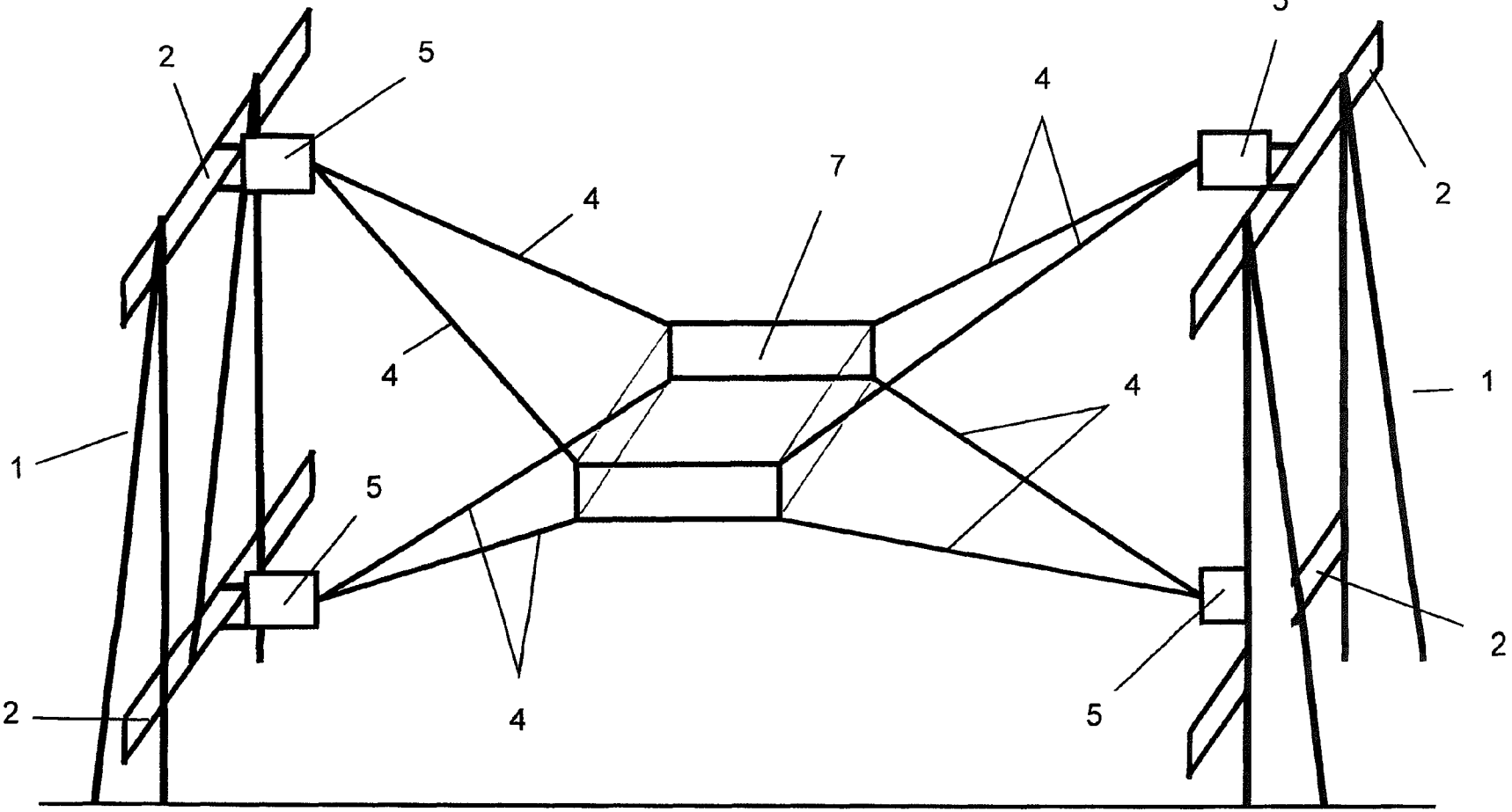
FIG. 17 shows an amusement ride according to the invention in which the platform is only movable in one vertical plane.

FIG. 17 shows in schematic view an amusement ride in which the platform 7 can only be moved in a vertical plane. Unlike the embodiment according to FIG. 16, this amusement ride has two rails 2 located one above the other at a distance on both of its retaining structures 1, on which respectively one winch 5 is disposed in a positionally fixed manner. Each winch 5 has a drum on which two cables 4 are wound. As FIG. 17 shows, the cables 4 act on mutually opposite sides of the platform 7. In this case, the cables 4 which act on the platform 7 at the same height are each guided to the winches 5. Each winch 5 produces a change in the effective length of respectively two cables 4. Since two cables in each case are wound on the same drum, they cannot be varied independently of one another in their effective length. The platform 7 can thus be moved only in one vertical plane by coordinated control of the winches 5.

It is further possible to provide a purely translational movement for the platform 7 in the space with three degrees of freedom.

Various types of drive systems of the amusement ride are described in detail with reference to FIGS. 18 to 27. With the drive system, the platform 7 can be moved in up to six degrees of freedom. As a result of the particular requirements for the transport of persons on pleasure amusement rides, measures are provide which ensure a safe and reliable operation of the amusement ride. It is ensured that the transmitted forces and the resulting accelerations of the platform 7 cannot exceed a maximum. The loads on the passengers on the platform 7 are thereby held in a permissible range. The drive systems are also configured so that introduction of forces onto the retaining structure 1 of the rails 2 lies below predefined maximum values. Furthermore, in particular when stopping the platform 7, it must be ensured that jerky forces are limited, which forces can arise, for example, as a result of the tensioning of hitherto untensioned cables or due to excessive forces when there is a lack of winch/lever synchronisation.

Figure 20:
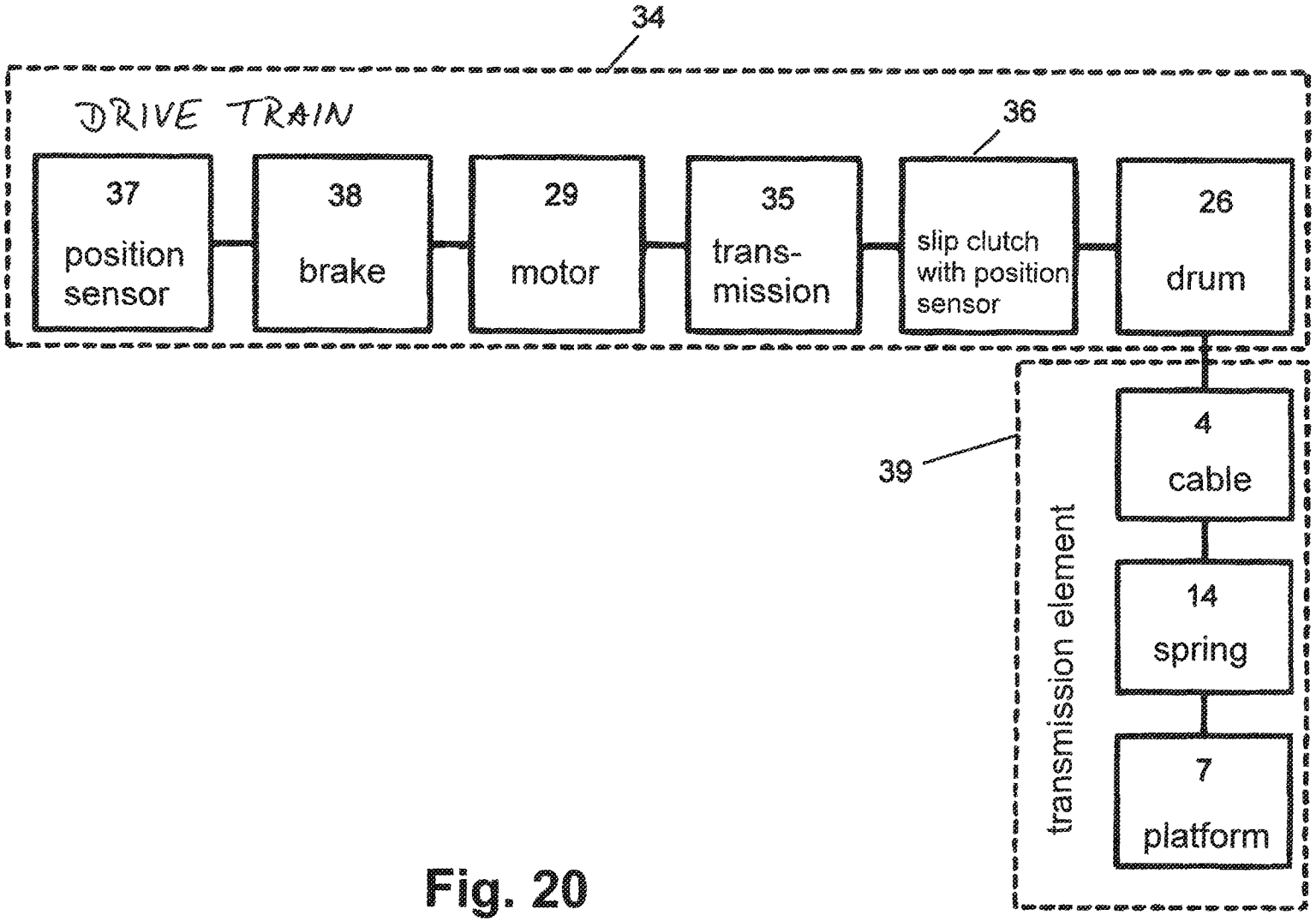
FIG. 20 shows a basic structure of the drive system of the amusement ride according to the invention comprising a drive train, a transmission element and an elastic element in the cable.

FIG. 20 shows a drive train 34 of the drive system. This contains the motor 29 which drives the cable drum 26 rotatably by means of a transmission 35. In order limit the maximum drive torque and therefore the cable force, a slipping clutch 36 is located in the drive connection between the transmission 35 and the drum 26. This can be provided with a position sensor.

The drive train 34 is provided with a position sensor 37 on the motor side, which for example is an angle encoder. The rotational position of the drum 26 and therefore the free cable length can be detected with the position sensor 37.

In order that the motor 29 is stopped in a defined and reliable manner, the motor is provided with a brake 38 for the rotational drive of the drum 26. The motor 29 can thus be brought to a standstill both via the motor braking torque and also independently of this via the brake 28.

The cable 4 that is wound onto the drum 26 or unwound from it is connected via the defined elastic element 14 (FIGS. 8 to 11) to the platform 7 and therefore controls the mobility of the platform 7.

The cable 4, the elements 14 and the platform 7 form a transmission element 39 that is part of the drive system. The slipping clutch 36 is advantageously provided in the drive train 34 but need not be part of the drive train 34. In this case, the drum 26 is directly connected to the transmission 35. The elastically resilient element 14 is also not absolutely essential but an advantageous feature.

Figure 18:
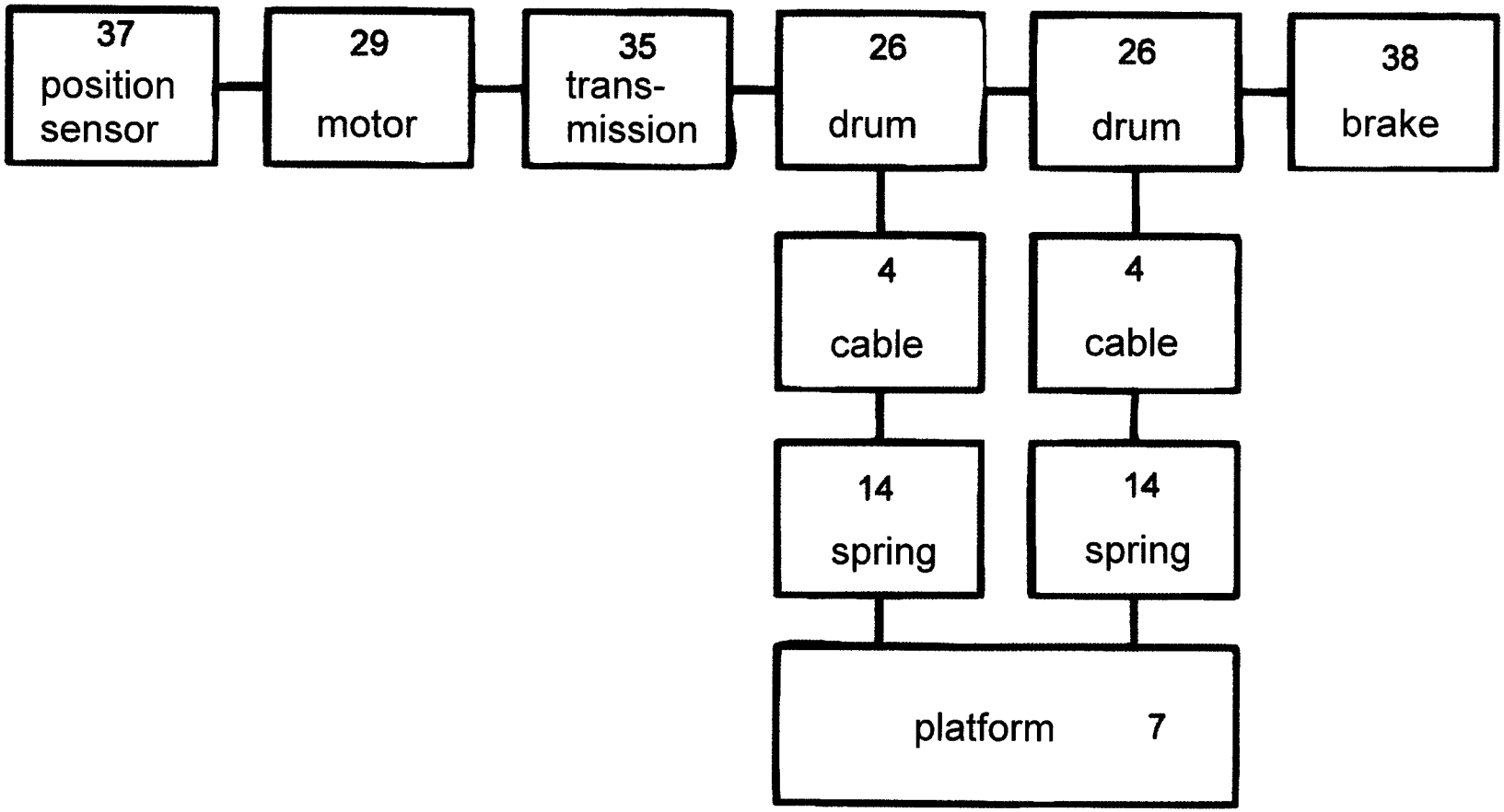
FIG. 18 shows a drive system of the amusement ride according to the invention with two drums on a drive train.

The drive train according to FIG. 18 has the position sensor 37, the motor 29 and the transmission 35 in the drive train. Two drums 26 onto which respectively one cable 4 can be wound are located in the drive train. Both drums 26 are therefore connected to the platform 7 via an independent parallel-guided cable. An element 14 is advantageously provided in each cable 4. The motor 29 drives the drums 26 arranged coaxially to one another via the transmission 35. The two drums 26 are braked by a common brake 38 which, unlike the embodiment according to FIG. 10, is disposed not on the motor side but on the drum side. Unlike the exemplary embodiment shown it is possible for the drums 26 to each use its own brake 38.

This drive system is characterised by its redundant configuration which on the one hand ensures a plate-shaped alignment of the platform-side cable ends and on the other hand ensures sufficient failure safety due to the redundancy in the machine elements.

Figure 19:
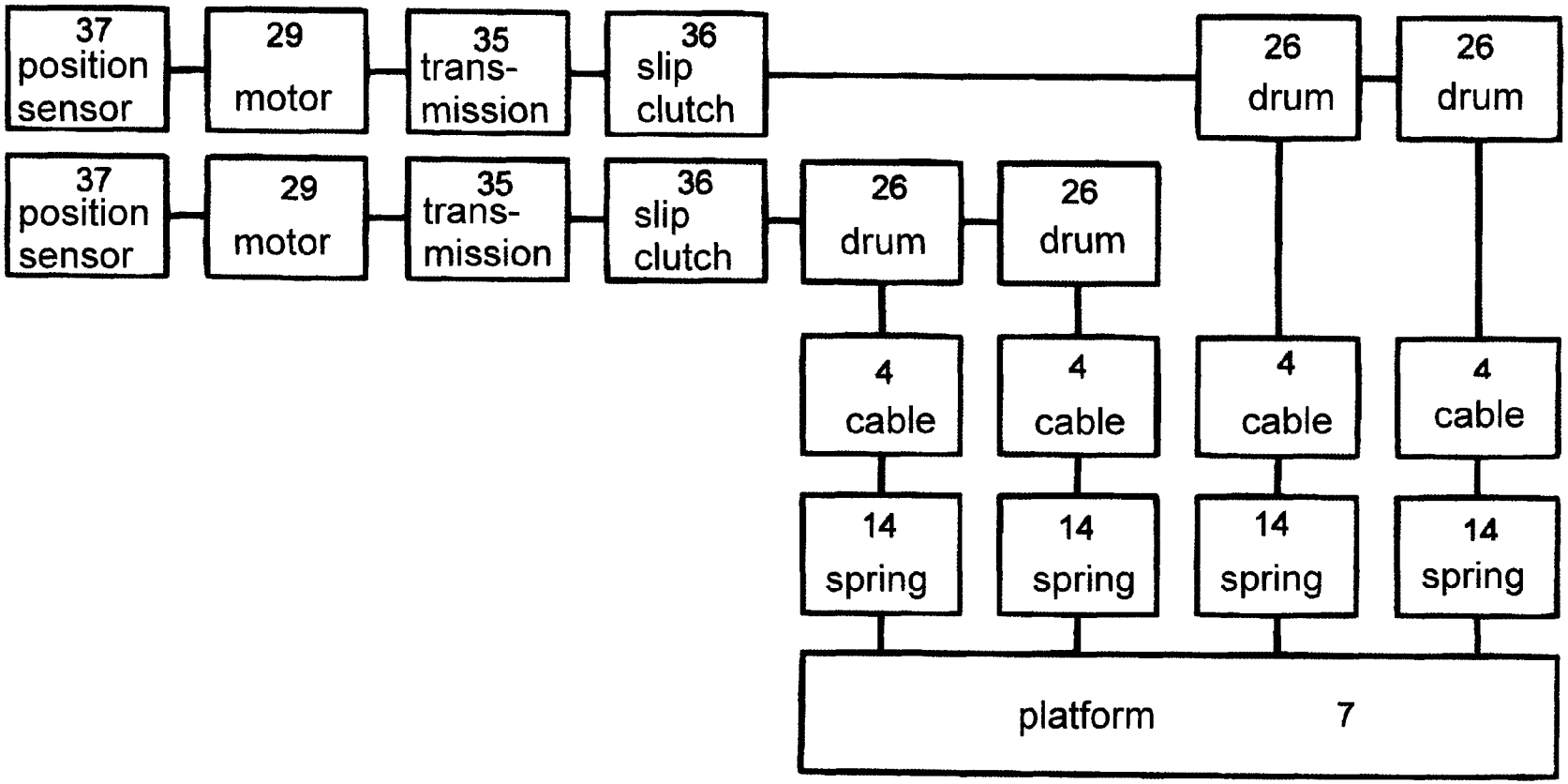
FIG. 19 shows a further embodiment of a drive system for four cables two motors.

FIG. 19 shows a safety-oriented winch drive with four parallel guided cables 4 and two independent drive systems, Respectively two drums 26 are driven simultaneous by the two drive systems. The two drive systems each have the motor-side position sensor 37, the motor 29, the transmission 35 and advantageously the slipping clutch 36. Respectively two drums 26 which sit on the same shaft are assigned to the two slipping clutches 36. The cables 4 are advantageously connected to the platform 7 via respectively one elastically resilient element 14.

In this embodiment not only the drums 26 but also the motor 29, the transmission 35, the slipping clutch 36 and the position sensor 37 are provided in a redundant manner. Such a configuration ensures a high failure safety.

Figure 21:
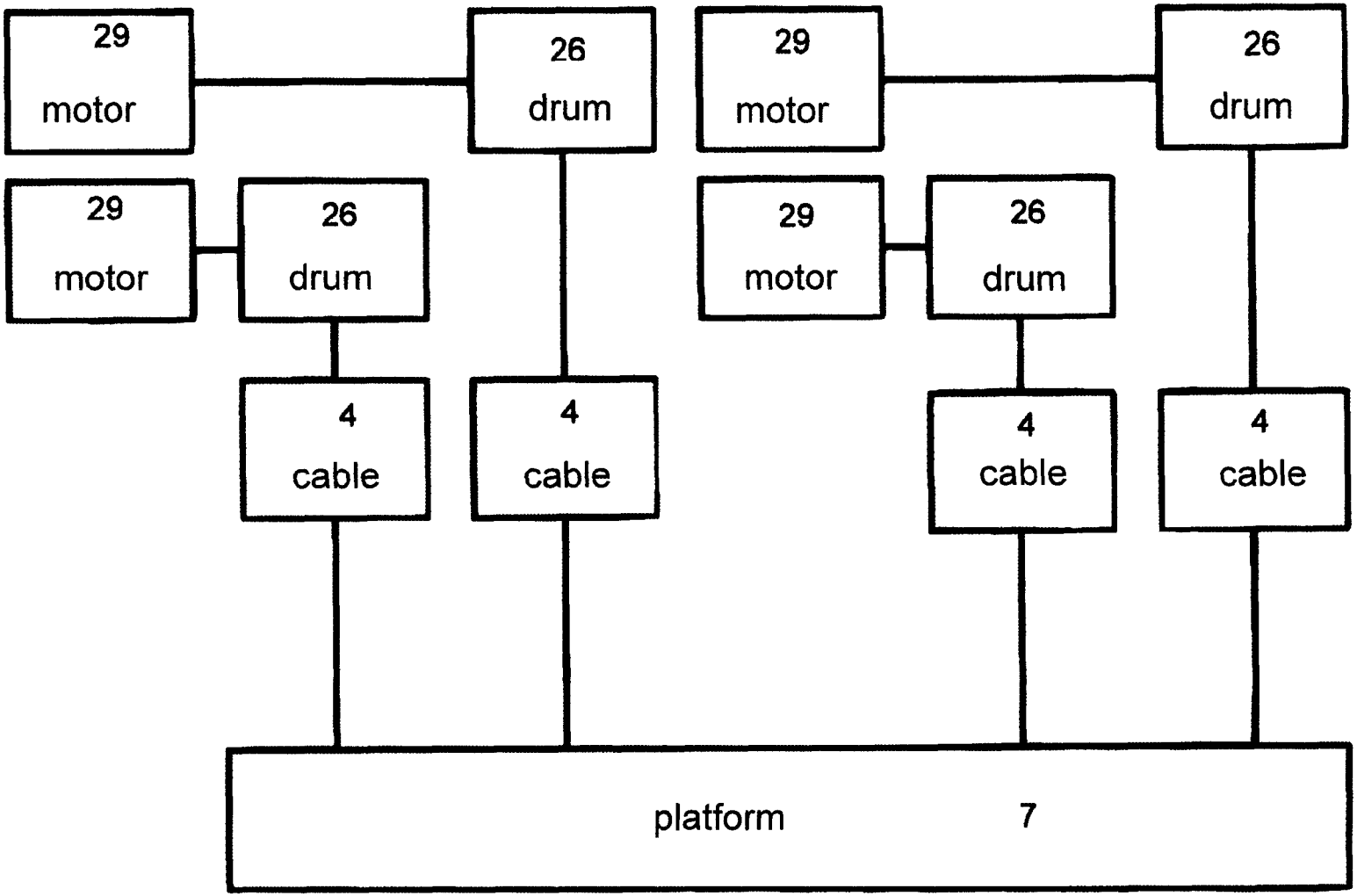
FIG. 21 shows a drive system for four cables with four motors for the amusement ride according to the invention.

In the exemplary embodiment according to FIG. 21, four cables are driven independently of one another and wound onto respectively one drum 26 or unwound from it independently of one another. Each drum 26 is rotatably driven by its own motor 29. The cables 4 are connected to the platform 7.

The drive systems according to FIG. 21 can be configured according to the drive systems according to FIGS. 18 to 20.

By reference to FIGS. 18 to 21 it has been shown that different degrees of redundancy can be used without restricting the functional principle of the amusement ride. The number of degrees of redundancy depends on the safety standard, on the desired movements and the requirements of the specific configuration of the amusement ride.

Although in the exemplary embodiments according to FIGS. 18 to 20, the cables 4 are fitted with at least one elastically resilient element 14, this configuration is not absolutely essential. In these embodiments the cables 4 can be connected directly to the platform 7 in accordance with the exemplary embodiment from FIG. 21. The elastically resilient elements can naturally also be provided in the embodiment according to FIG. 21. In principle, the use of the elastically resilient elements merely depends on safety requirements and specifications of the particular application.

The elastically resilient element is controlled by data processing in a computer. The movement of the platform 7 in up to six degrees of freedom is freely programmable. Movement profiles that are pre-calculated or to be determined during operation of the amusement ride are executed by means of the drive systems of the amusement ride described. It is thereby possible to change the movement of the platform 7 at short intervals on a single installation of the amusement ride. As a result of the processing of the data during operation, the movement of the platform 7 can also be adapted to the behaviour or the inputs of the passengers so that an interaction is possible during the travel.

The controller 12 (FIG. 22) produces movement profiles 42 for the individual drives on the basis of a program sequence 40 or as a result of user inputs at an input device 41. The movement profiles 42 are pre-processed by a pre-controller 43 and a position regulator 44 for the individual drives. The data thus obtained are sent as desired values to the decentralised drive modules of the individual carriages via an interface 45, preferably a field bus.

For example, a carriage 1 and a carriage n are shown in FIG. 22. The particular desired value for the winch motor 29 is transmitted to these carriages. The desired value is additionally transmitted to a carriage motor 46. According to the desired values, the respective drum 26 of the winch 5 is turned in the required direction and thus adjusts the free cable length. In addition, the carriage 3 is moved along the rails 2 according to the transmitted desired value. Sensors 47 which in particular detect the position of the carriage 3 on the rails 2 and the adjusted free cable length transmit the corresponding actual values to the interface 45 of the controller 12. The transmitted actual values are compared with the desired values in the regulator 44. As soon as a difference appears between the desired and the actual value, a corresponding control signal is transmitted to the appropriate winch motor 29 or the corresponding carriage motor 46 via the corresponding interface 45. As a result of this regulation, the platform 7 moves exactly along the desired movement path 11.

Since the movement of the platform 7 is freely programmable, in particular movements can be produced which cause the illusion of specific movement sequences in the passengers.

Thus, the illusion of weightlessness can be produced in the passengers by moving the platform 7 on a parabolic movement path 11 such as is shown as an example in FIGS. 2 and 3. The parabolic movement path is achieved by corresponding coordinated winding and unwinding of the cables onto the appropriate winches 5, As a result, such a movement path can also be achieved with straight-running rails 2.

The movement path 11 of the platform 7 can also be formed so that the passengers on the platform 7 have the sensation of a partial or complete acceleration due to gravity. The movement is produced so that the relative acceleration of the platform 7 downwards acts to counteract the force of gravity for a time interval. This produces the impression of weightlessness for the passengers on the platform 7.

The platform 7 can also be moved to that it executes rotary movements in which the instantaneous pivot point can be determined independently of the technical configuration of the amusement ride. The passenger thus has the illusion of a pendulum motion of the platform 7 with a pivot point which can lie outside the platform 7 or even outside the amusement ride.

By appropriate programming of the movement path, the illusion of a flight movement can also be imitated where the behaviour of vehicles, aircraft or other (fictitious) flying objects such as birds, dragons etc. can be imitated. To this end the movements of the platform 7 can be composed of lines and curves so that for example the flapping of wings can be perceived by the accelerations. As is described and set out with reference to FIG. 4, defined acceleration states and defined acceleration profiles can be produced. As a result of a rapid change in the direction of acceleration, the passenger perceives such movements of the platform 7 as quaking and vibrations. If the platform 7 follows circular arcs with varying speed, the impression is given that it is swinging on a long pendulum. Large accelerations with simultaneous tilting of the platform give the impression of starting and braking. In the event of particularly jerky movements, the impression of a collision with other objects is given.

With the aid of the controller 12, it is further possible to make the movement state of the platform 7 follow a reference movement. Such a reference movement can be predefined by the operator or by multimedia sources such as simulations or films. As a result of the exact path control of the platform 7, the movement of the platform can communicate with the reference movement.

The movement of the platform 7 can also be changed by inputs made by the passengers. Corresponding input devices 41 can be provided on the platform 7 at which the passengers can make their inputs. By this means, for example, the behaviour of ships, boats, vehicles, aircraft, space ships and the like can be recreated and made to come alive for the passenger.

In particular, the free controllability of the amusement ride makes it possible to switch between different types of movement in the course of the travel or between individual trips without mechanical adaptation of the amusement ride.

In order to enable the described possibilities for path control, a sensor-based detection of the operating state of the platform 7 is provided. For this purpose in particular a length, speed, acceleration and force measurement is made in the cables 4 or, if rods are used, in these rods. The measurement of the movement state of the platform 7 can be made with gyroscopes or with (differential) satellite navigation (GPS) to determine the actual movement.

The controller 12 is provided to produce the control profiles for the drives with the program generator 40 or with the input device 41 that can be actuated either by the operating staff of the amusement ride or by the passenger.

The controller described can also be used for such embodiments in which the amusement ride has no winches 5 or levers 31. In this case, the cables 4 have a constant length and can, for example, be replaced by rods. In this case, the movement of the platform is accomplished only by appropriate movement of the carriages 3 along the rails 2 (FIG. 6*a*). In such cases, the carriage motor 45 receives the desired value. The sensors 47 detect the position of the carriage 3 on the rails 2 and return the corresponding actual values to the controller 12. With the aid of the regulator 44 it is checked whether the returned actual value corresponds to the predefined desired value. If differences occur, a control signal is generated which is transmitted to the particular carriage motor 46.

If the amusement ride does not have any carriages but only invariable-position winches 5 or levers 31, the desired value is transmitted to the corresponding winch/lever motor 29. The sensors 47 detect the angle of rotation and therefore the free cable length and return the corresponding actual value to the controller 12. The regulator 44 optionally generates a regulating signal in order to accordingly regulate the corresponding winch/lever motor 29.

Figure 23:
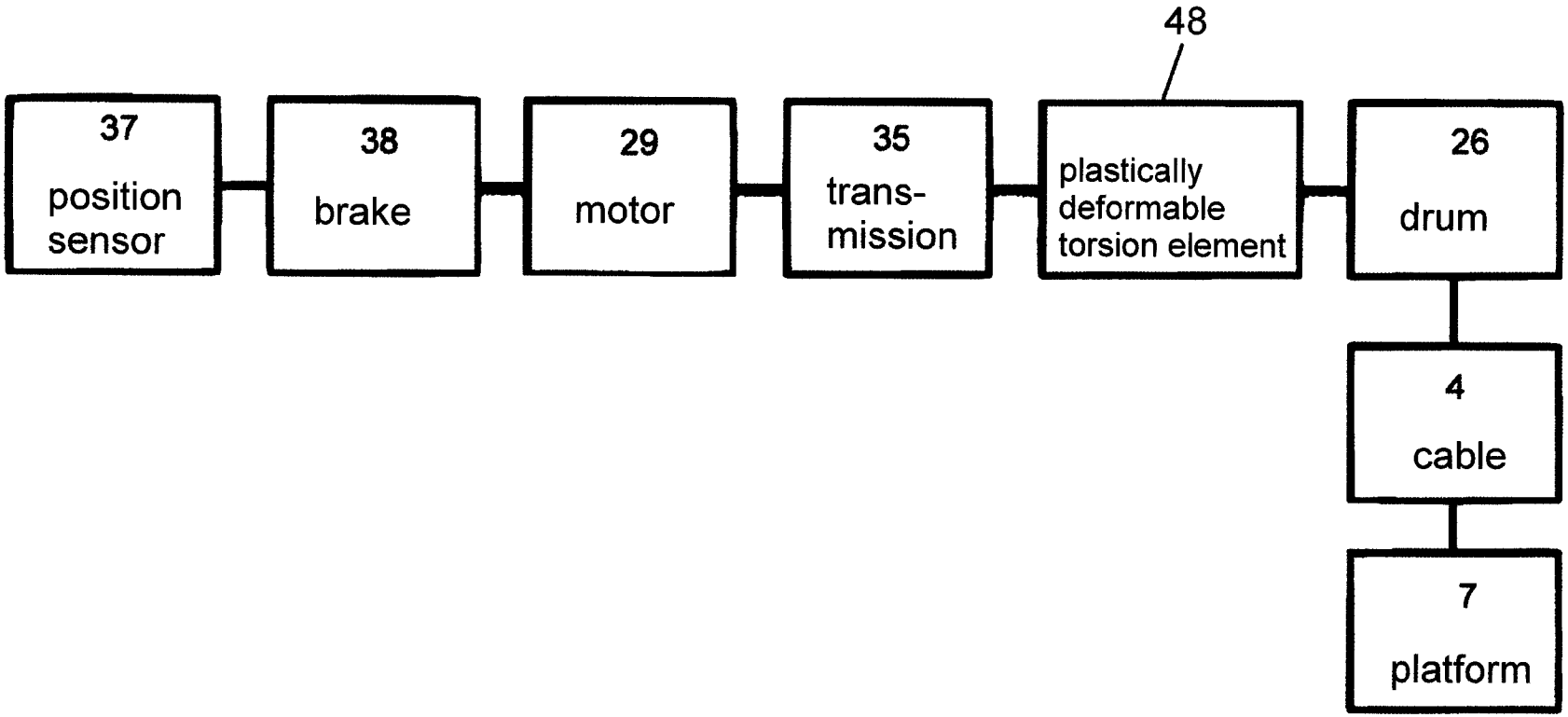
FIG. 23 shows another possibility of a drive for the amusement ride according to the invention with a plastically deformable torsion element in the drive train of the cable winch.

FIG. 23 shows a drive train similar to FIG. 20 in which instead of the slipping clutch 36 a plastically deformable torsion element 48 is provided. This plastically deformable torsion element 48 can absorb excessive forces which occur upon stopping, for example, as a result of a defect, due to plastic deformation. This prevents any overloading of the structure of the amusement ride and/or the passengers. The plastically deformable torsion element is advantageously configured as a crumple element with which an overloading in the case of danger can be reliably prevented.

The cable 4 is otherwise connected directly to the platform 7. The cable 4 can, however, also be connected to the platform 7 via at least one element 14.

Figure 24:
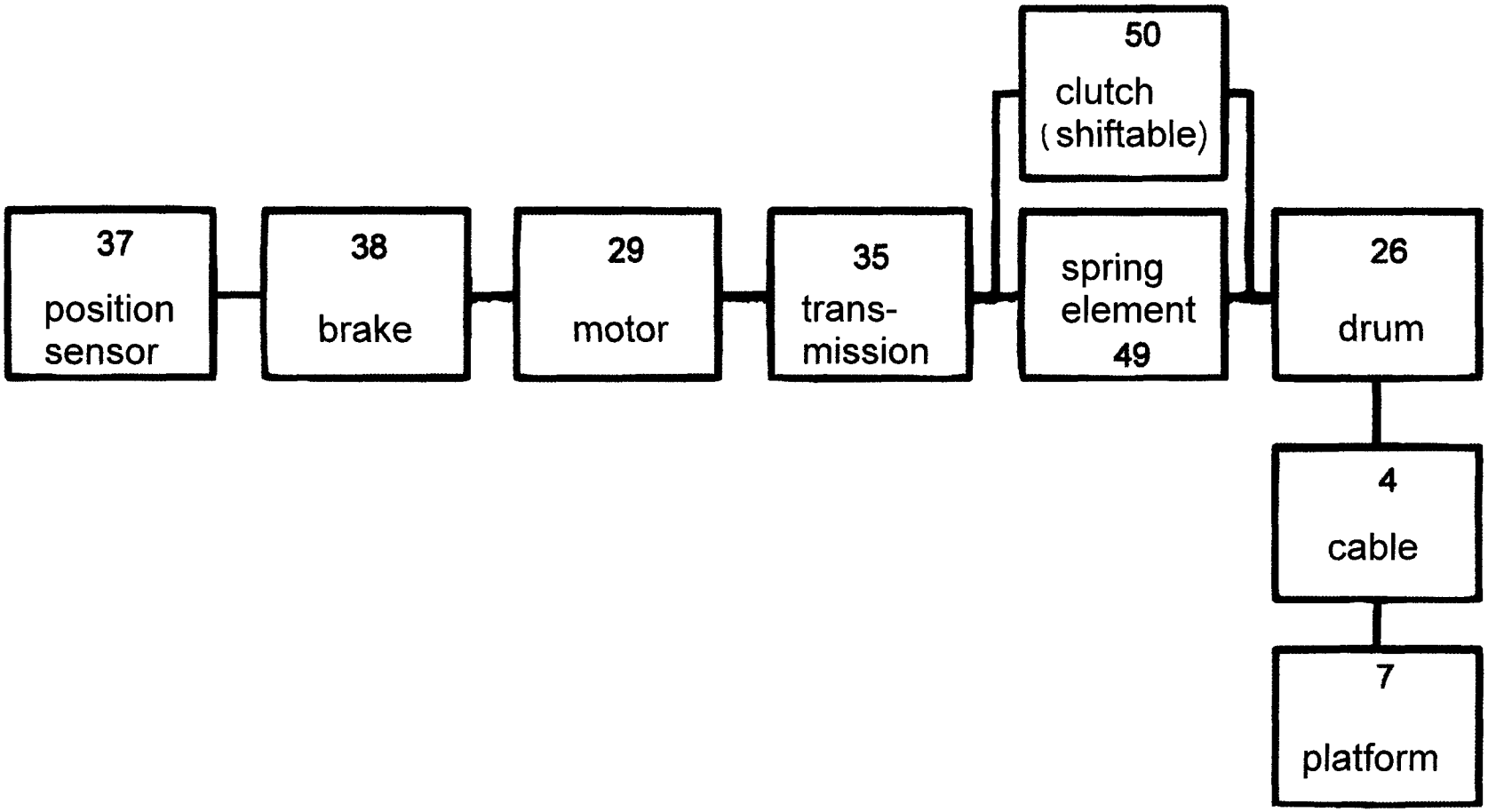
FIG. 24 shows another embodiment of a drive system of the amusement ride according to the invention with a shiftable clutch for bridging an elastic element in the drive train of the winch for nominal operation.

The drive train according to FIG. 24 has the motor 29 with the motor-side brake 38 and the motor-side position sensor 37. The motor 29 is coupled via the transmission 35 and a spring element 49 to the drum 26. The spring element 49 is advantageously a torsion or torsional spring which is part of the drum 26 and prevents any overloading of the drum 26 and therefore the cable 4. The spring element 49 can be bridged via a clutch 50. The clutch 50 is a shifting clutch which couples the transmission 35 directly to the drum 26 in the engaged state. If the clutch 50 is disengaged, the spring element 49 can then become effective.

The cable 4 is connected directly to the platform 7. However, it is also possible to connect the cable via at least one element 14 to the platform 7.

The spring element 49 is not effective during normal operation of the amusement ride. The clutch 50 is engaged and bridges the spring element 49. The drum 26 is driven directly by the transmission 35. With loss of energy (risk of slackening cable tension), the clutch 50 is disengaged. The spring element 49 can now tension the cable 4 and enables a certain resilience of the drive train.

Figure 25:
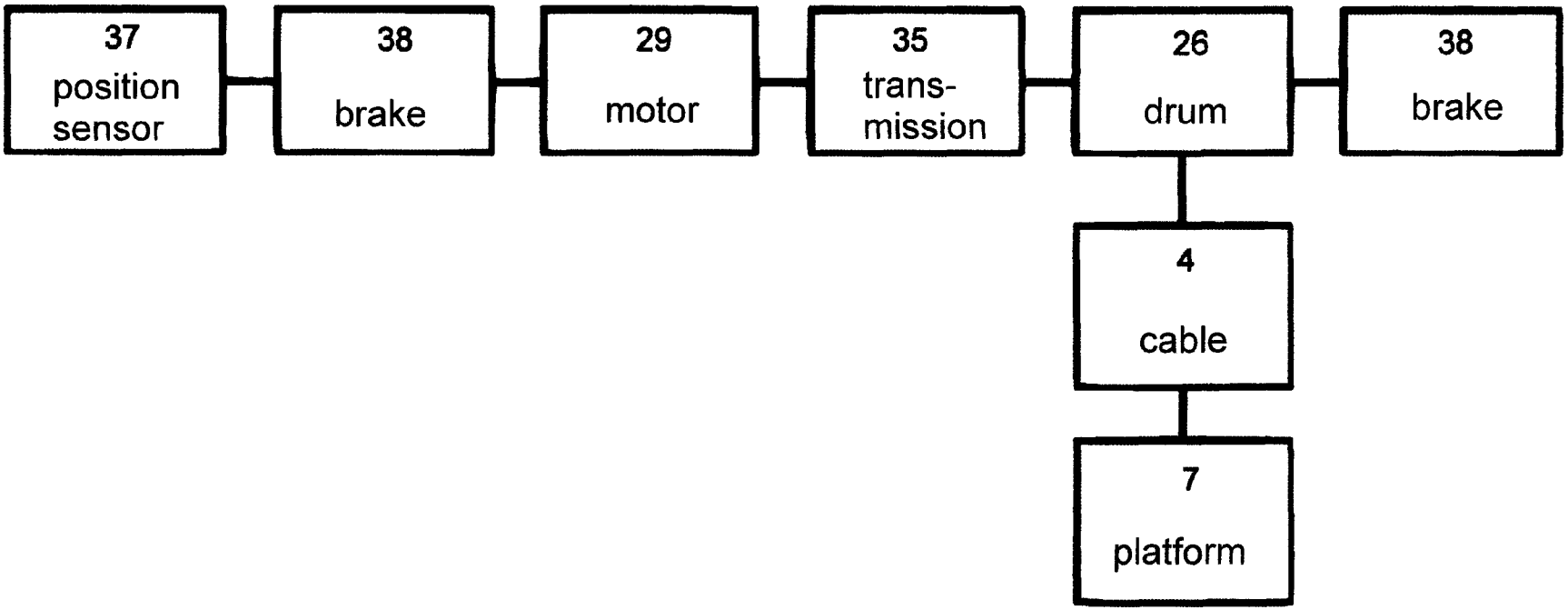
FIG. 25 shows another possibility of a drive system for the amusement ride according to the invention with a redundant brake.

The drive train according to FIG. 25 has the motor 29 with the motor-side brake 38 and the motor-side position sensor 37. The motor 29 is drivingly connected to the drum 26 via the transmission 35. The brake 38 is assigned to it. The cable 4 is connected to the platform 7 directly or via interposed spring elements. This embodiment is an example for the redundant arrangement of brakes in the drive system.

Figure 26:
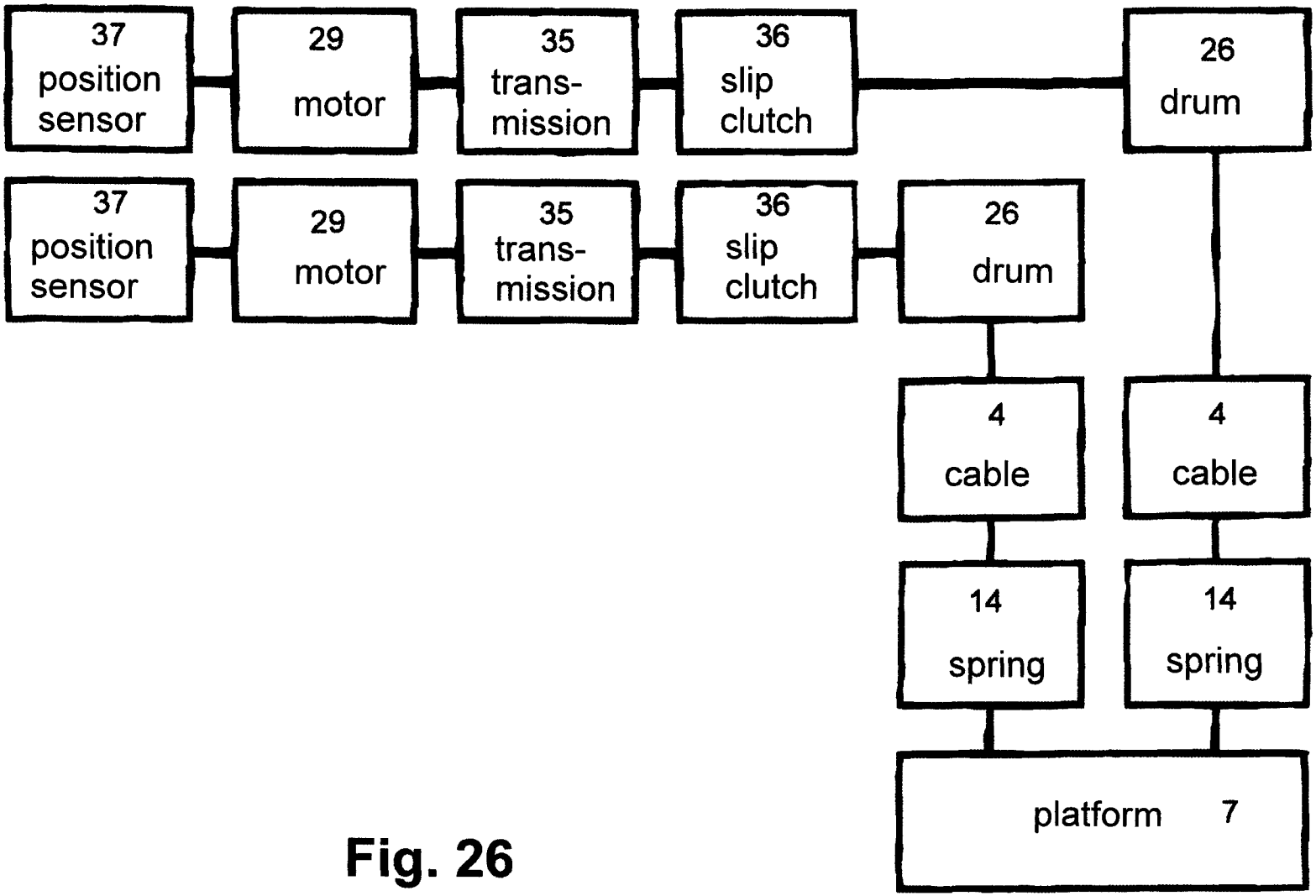
FIG. 26 shows another embodiment of a drive system for the amusement ride according to the invention for two cables with two motors.

The drive system according to FIG. 26 is constructed redundantly and has two drive trains which each drive one drum 26. Each drive train has the motor 29 with the motor-side position sensor 37. Each motor 29 is connected to the respective drum 26 via the transmission 35 and a slipping clutch 36. The cables 4 of the drum 26 are connected to the platform 7 with respectively at least one interposed spring element 14. The spring elements 14 are only provided optimally; the cables 4 can also be connected directly to the platform 7.

Figure 27:
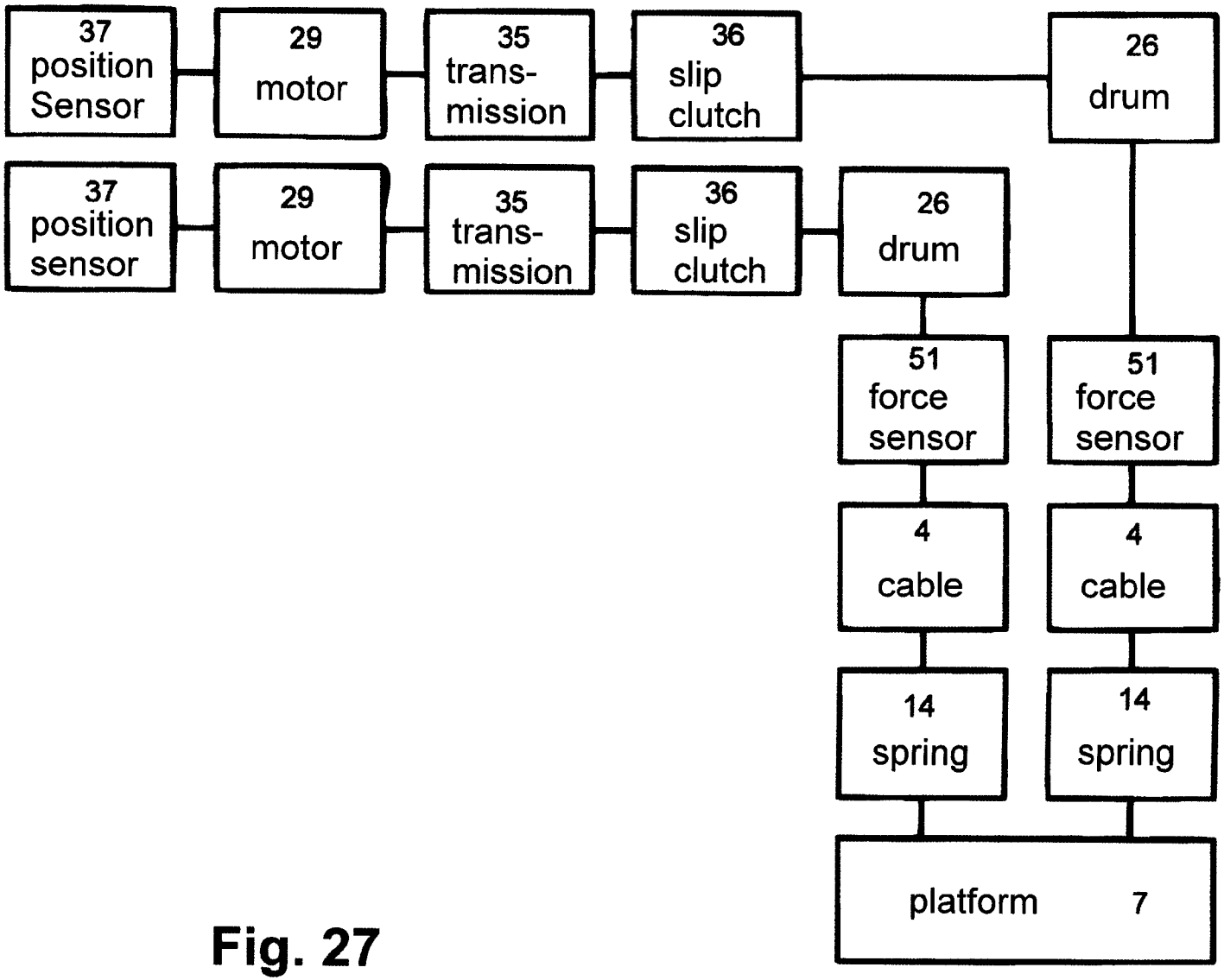
FIG. 27 shows the drive system according to FIG. 26 with two force sensors.

FIG. 27 shows a drive controller which is configured substantially the same as the exemplary embodiment according to FIG. 26. A force sensor 51 and at least one element 14 is located in the cable 4 of each drum 26.

The force sensors 51 can be provided on all the cables 4 of the amusement ride but also on only one or several of the cables. This embodiment is an example for the redundant arrangement of the position and force sensors 37, 51 to increase the safety.

The amusement rides described are characterised by a high flexibility and an excellent riding experience. The amusement rides have similar performance properties (speed, acceleration, track length, passenger capacity) to the conventional roller coasters. Possible performance indices are given as an example hereinafter. These values are not to be understood as restrictive values.

The platform 7 can thus have a weight in the range of for example 200 kg to 4000 kg which corresponds to a conveying capacity of, for example, 1 to 10 persons. The platform 7 can have a maximum rotational acceleration of the order of magnitude of 90°/s and a translational acceleration of about 2 to 3 g. In this case, the platform 7 can have a typical rotational speed of 90°/s and a typical translational speed of about 10 m/s.

The amusement ride is provided with a safety monitoring system that evaluates all the control and sensor signals in order to monitor correct operation of the amusement ride. Here it is advantageous if a multichannel design of a monitoring device is used. To this end redundant signals of the drives and sensors are used by the active elements carriage 3 and winch 5. In the event of an unexpected state, the safety monitoring system initiates a defined stoppage of the amusement ride, for example, by means of an emergency stop. As is described by reference to FIGS. 18 to 27 as an example, the subsystems provided in the safety-oriented drive system are used here so that even in the event of a partial system failure, a stoppage is possible without hazardous acceleration values being achieved for the passengers.

As the various embodiments of the drive systems show, elements can be provided in the drive system which guarantee the maintaining of a minimum force even when a subsystem fails. An ordered stoppage of the amusement ride without crashing of the platform 7 is then ensured.

If the brakes are provided redundantly according to the embodiment from FIG. 25, a stoppage of the amusement ride is ensured even when an individual brake fails. Furthermore, the brakes double the delay function which can be generated by the motor 29. The brakes can be supplied with locally stored energy, possibly from springs.

With a view to the safety of the amusement ride, the force, position, speed and/or acceleration sensors described are advantageously provided on several or all of the parallel guided cables 4. The force limitation of the cables 4 is achieved by torque limitation by the slipping clutches 36 described as an example in the drive train (FIG. 26). The force limitation can also be achieved by friction drives (FIG. 13) for the winches 5. The drive of the carriages 3 by friction drives is a preferred embodiment of the drive system when the carriages 3 have no winches and the platform is exclusively moved by appropriate movement of the carriages.

If a decentralised multi-channel motor controller is used, the movement behaviour during a stoppage of the amusement ride in the case of an emergency stop can also be ensured autonomously without connection to the central control system 12. In this case, a local energy storage system can be used for the drives. In this case, the drives of the individual carriages 3 shown in FIG. 22 are able to initiate and monitor a controlled braking of the platform 7 to a standstill in the event of a failure of the power supply.

The various elements of the amusement ride can be combined with one another depending on the configuration of the amusement ride. Individual machine elements can be provided redundantly so that in the event of a failure of individual machine elements, further operation of the amusement ride is nevertheless still possible or the amusement ride can be fixed without risk for the passengers on the platform 7.

The embodiments described show that the spring elements can be used in the drive train, in particular the springs in the cables 4, the torsional springs in the drum 26 of the winch 5 and the springs 33 at the fixing points of the cables on the platform.

The free programmability of the movement path of the platform 7 enables longer distances to be travelled and the movement profile of the platform 7 to be varied without changing the mechanical construction of the amusement ride.

The amusement rides can be used for most diverse applications. For example, it is possible to use them for amusement rides in which the experience of accelerations and for this an exciting riding experience are produced. The platform 7 can also be employed for use in the dark.

As a result of the mobility described, the platform 7 can also be used as a moving platform in film screenings in which the platform 7 and therefore the passengers synchronously execute movements with the film to be seen in each case.

The platform 7 can also be used as a moving platform for simulators.

The amusement ride is characterised by its constructive simplicity. The transmission of force between the carriage 3 and the platform 4 is accomplished merely through the cables 4 or corresponding rods. The movement path 11 of the platform 7 can be freely programmed in at least two degrees of freedom, in particular in six degrees of freedom (three translational and three rotational degrees of freedom). Defined acceleration or movement states can be simply produced with the superordinate controller 12. Defined paths and trajectories can also be travelled with the superordinate controller 12. If the carriages 3 are moved along the rails 2, the platform 7 can be transported over greater distances where the platform 7 can executed most diverse movements in a controlled manner during travel. The platform 7 can be controlled in various ways. The movement, the speed and the acceleration of the platform 7 can be controlled so that these are experienced as pleasant or as thrills.

Since the cables 4 and the platform 7 only have a relatively small own mass, a high dynamics of the platform 7 can be achieved in a simple manner. The structure of the amusement ride only has a very small interfering contour so that for the passengers of the platform, for example, the illusion of flying is produced.

Since the platform 7 does not move directly on rails, the movement sequence of the platform 7 cannot be foreseen or only with very great difficulty for the passengers, thus increasing the thrill of the ride.

What is claimed is:

1. An amusement ride comprising:

a retaining structure;

at least one platform;

retaining elements, wherein the at least one platform is connected in an articulated manner to the retaining elements and the retaining elements hold the at least one platform on the retaining structure;

wherein the retaining elements are cables which are under tensile stress during operation of the amusement ride;

wherein the retaining structure comprises rails arranged in pairs above each other on opposite sides of the platform;

further comprising drives arranged on the rails and distributed on the rails in an arrangement around the platform above and below the platform, wherein the drives are moveable along the rails;

further comprising a central controller to which the drives are connected;

wherein the cables are connected to the drives and to the platform, wherein the cables each extend at a slant from the platform to the drives above or the drives below the platform, wherein the central controller controls the platform in six degrees of freedom, and wherein the cables are tensioned during operation by the tensile stress such that the platform is securely braced in any position and orientation.

2. The amusement ride according to claim 1, wherein the cables have an effective length and the effective length of the cables is variable.

3. The amusement ride according to claim 1, further comprising cable winches disposed on the retaining structure and adapted to wind the cables.

4. The amusement ride according to claim 3, wherein the cable winches are drivable independently of one another.

5. The amusement ride according to claim 3, wherein the cable winches are disposed above the platform and the cables are tensioned by the weight of the platform.

6. The amusement ride according to claim 1, wherein cable winches that wind the cables are arranged on the drives.

7. The amusement ride according to claim 6, wherein the cable winches are drivable by a motor.

8. The amusement ride according to claim 6, wherein the motors of the cable winches that wind the cables are connected to the central controller and wherein the drives and the motors are arranged in a control circuit of the central controller.

9. The amusement ride according to claim 1, wherein the drives are actuatable independently of one another.

10. The amusement ride according to claim 1, wherein at least some of the cables are provided redundantly.

11. The amusement ride according to claim 1, further comprising:

pivotable levers connected to ends of the cables remote from the platform and acting on the cables;

wherein the the pivotable levers are connected to the central controller and wherein the drives and the pivotable levers are arranged in a control circuit of the central controller.

12. An amusement ride comprising:

a retaining structure;

at least one platform;

retaining elements, wherein the at least one platform is connected in an articulated manner to the retaining elements and the retaining elements hold the at least one platform on the retaining structure;

wherein the retaining elements are cables which are under tensile stress during operation of the amusement ride;

wherein ends of the cables facing away from the at least one platform are connected to pivotable levers and wherein the pivotable levers are optionally drivable independently of one another.

13. The amusement ride according to claim 12, further comprising drives, wherein the retaining structure comprises guides, wherein the drives are moveable along the guides, wherein the cables are connected to the drives.

14. The amusement ride according to claim 12, wherein a motor of the pivotable lever is positioned in a drive train which is provided with at least one brake for the pivotable lever, wherein the brake is optionally provided redundantly.

15. An amusement ride comprising:

a retaining structure;

at least one platform;

retaining elements, wherein the at least one platform is connected in an articulated manner to the retaining elements and the retaining elements hold the at least one platform on the retaining structure;

wherein the retaining elements are cables which are under tensile stress during operation of the amusement ride;

further comprising at least one elastically resilient element that is located in at least some of the cables, or in a connection of the cables to the platform, or in a connection of the cables at an end remote from the platform.

16. The amusement ride according to claim 15, wherein the at least one elastically resilient element is effective permanently or at the time of braking of the cables or braking of the platform.

17. The amusement ride according to claim 15, further comprising at least one energy dissipation element that is located in at least some of the cables, or in connections of the cables to the platform, or in ends of the cables remote from the platform.

18. The amusement ride according to claim 17, wherein the at least one energy dissipation element is effective permanently or at the time of braking of the cables or braking of the platform.

19. An amusement ride comprising:

a retaining structure;

at least one platform;

retaining elements, wherein the at least one platform is connected in an articulated manner to the retaining elements and the retaining elements hold the at least one platform on the retaining structure;

wherein the retaining elements are cables which are under tensile stress during operation of the amusement ride;

further comprising tensioning elements acting on at least some of the cables at the platform or at cable winches, wherein the tensioning elements pretension and deflect the corresponding cable.

20. An amusement ride comprising:

a retaining structure;

at least one platform;

retaining elements, wherein the at least one platform is connected in an articulated manner to the retaining elements and the retaining elements hold the at least one platform on the retaining structure;

wherein the retaining elements are cables which are under tensile stress during operation of the amusement ride;

wherein the cables have an effective length and the effective length of the cables is variable;

wherein the cable winches are drivable by a motor;

wherein the motor of the cable winch is positioned in a drive train which is provided with at least one brake for a cable drum of the cable winch, wherein the brake is optionally provided redundantly.

21. The amusement ride according to claim 20, wherein a first and a second one of said at least one brake are provided, wherein the first brake is provided on the motor side of the drive train and the second brake is provided on the cable drum side of the drive train.

22. The amusement ride according to claim 21, wherein a slipping clutch is connected before the cable drum.

* * * * *

UNITED STATES PATENT AND TRADEMARK OFFICE

CERTIFICATE OF CORRECTION

PATENT NO. : 8,920,251 B2
APPLICATION NO. : 13/623208
DATED : December 30, 2014
INVENTOR(S) : Thomas Dietz et al.

It is certified that error appears in the above-identified patent and that said Letters Patent is hereby corrected as shown below:

On the Title Page, at (71) Applicants, last name of fourth applicant "Verf" should read --Verl--.

On the Title Page, at (72) Inventors, last name of fourth inventor "Verf" should read --Verl--.

Signed and Sealed this
Fourteenth Day of April, 2015

Michelle K. Lee

Michelle K. Lee
*Director of the United States Patent and Trademark Office*